US008752242B2

(12) United States Patent
Miner et al.

(10) Patent No.: US 8,752,242 B2
(45) Date of Patent: Jun. 17, 2014

(54) VACUUM CLEANER BASE WITH NOZZLE HEIGHT ADJUSTMENT

(75) Inventors: Jonathan L. Miner, Rockford, MI (US); George Moyher, Jr., Cedar Springs, MI (US); Gary A. Kasper, Grand Rapids, MI (US); Tom Minh Nguyen, Grand Rapids, MI (US); Alan J. Krebs, Pierson, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 13/366,754

(22) Filed: Feb. 6, 2012

(65) Prior Publication Data

US 2012/0131764 A1 May 31, 2012

Related U.S. Application Data

(63) Continuation of application No. 11/813,821, filed as application No. PCT/US2006/026696 on Jul. 11, 2006, now abandoned.

(60) Provisional application No. 60/595,515, filed on Jul. 12, 2005.

(51) Int. Cl.
*A47L 5/34* (2006.01)
*A47L 9/04* (2006.01)

(52) U.S. Cl.
CPC . *A47L 5/34* (2013.01); *A47L 9/0494* (2013.01)
USPC ..... 15/362; 15/354

(58) Field of Classification Search
CPC ..... A47L 5/34; A47L 9/0494
USPC ..... 15/354–356, 362, 49.1, 50.1, 52.1, 98
IPC ..... A47L 5/34
See application file for complete search history.

(56) References Cited

U.S. PATENT DOCUMENTS

| | | | | |
|---|---|---|---|---|
| 1,448,349 | A | | 3/1923 | Hoover |
| 1,448,397 | A | | 3/1923 | Friend |
| 2,067,990 | A | | 1/1937 | Taylor |
| 2,146,602 | A | | 2/1939 | Spooner, Jr. |
| 2,172,911 | A | | 9/1939 | Kirby |
| 2,823,412 | A | | 2/1958 | Kirby |
| 3,909,874 | A | | 10/1975 | Clower et al. |
| 4,078,275 | A | | 3/1978 | Baird |
| 4,437,205 | A | | 3/1984 | Koland |
| 4,467,495 | A | * | 8/1984 | Fish et al. ..... 15/354 |
| 4,571,772 | A | | 2/1986 | Dyson |

(Continued)

FOREIGN PATENT DOCUMENTS

| | | |
|---|---|---|
| DE | 654927 | 12/1937 |
| GB | 452405 A | 8/1936 |

(Continued)

*Primary Examiner* — David Redding
(74) *Attorney, Agent, or Firm* — McGarry Bair PC

(57) ABSTRACT

An upright vacuum cleaner comprises a base assembly pivotally connected to an upright assembly. The base assembly comprises housing, a support, and a ratchet-operated nozzle height adjustment mechanism for raising or lowering a suction nozzle on the base assembly relative to a surface to be cleaned. The ratchet-operated nozzle height adjustment mechanism includes a ratchet mechanism for raising and lowering the housing relative to the support.

11 Claims, 27 Drawing Sheets

(56) References Cited

U.S. PATENT DOCUMENTS

| | | | | |
|---|---|---|---|---|
| 4,955,103 | A | 9/1990 | Scott et al. | |
| 5,042,109 | A | 8/1991 | Stephens | |
| 5,134,750 | A * | 8/1992 | King et al. | 15/333 |
| 6,810,557 | B2 | 11/2004 | Hansen et al. | |
| 2004/0200031 | A1 | 10/2004 | Park | |
| 2008/0109985 | A1 | 5/2008 | Park et al. | |

FOREIGN PATENT DOCUMENTS

| | | | |
|---|---|---|---|
| GB | 748574 | A | 5/1956 |
| JP | 57131420 | A | 8/1982 |
| KR | 101999061203 | | 2/2001 |
| KR | 1020010012060 | | 2/2001 |
| WO | 9829021 | A1 | 7/1998 |

* cited by examiner

VACUUM CLEANER BASE WITH NOZZLE HEIGHT ADJUSTMENT

CROSS REFERENCE TO RELATED APPLICATIONS

This application is a continuation-in-part of U.S. patent application Ser. No. 11/813,821, filed, Oct. 13, 2008, now abandoned, which is a national stage application of PCT No. PCT/US06/26696, filed Jul. 11, 2006, which claims the benefit of U.S. Provisional Patent Application No. 60/595,515, filed Jul. 12, 2005, all of which is incorporated herein by reference in their entirety.

BACKGROUND OF THE INVENTION

1. Field of the Invention

The invention relates to suction cleaners, and in particular, to adjusting the vertical position of a suction nozzle of the base portion of a vacuum cleaner.

2. Description of the Related Art

Upright vacuum cleaners employing cyclone separators are well known. Some cyclone separators follow textbook examples using frusto-conical shape separators and others use high-speed rotational motion of the air/dirt to separate the dirt by centrifugal force. Typically, working air enters and exits at an upper portion of the cyclone separator as the bottom portion of the cyclone separator is used to collect debris. Furthermore, in an effort to reduce weight, the motor/fan assembly that creates the working air flow is typically placed at the bottom of the handle, below the cyclone separator.

BISSELL Homecare, Inc. presently manufactures and sells in the United States an upright vacuum cleaner that has a cyclone separator and a dirt cup. A horizontal plate separates the cyclone separator from the dirt cup. The air flowing through the cyclone separator passes through an annular cylindrical cage with baffles and through a cylindrical filter before exiting the cyclone separator at the upper end thereof. The dirt cup and the cyclone separator are further disclosed in the U.S. Pat. No. 6,810,557 which is incorporated herein by reference in its entirety.

U.S. Pat. No. 4,571,772 to Dyson discloses an upright vacuum cleaner employing a two stage cyclone separator. The first stage is a single separator wherein the outlet of the single separator is in series with an inlet to a second stage frusto-conical separator.

SUMMARY OF THE INVENTION

According to one embodiment of the invention, a vacuum cleaner comprises a base assembly having a housing, a suction nozzle, a pair of wheels at a rear portion of the housing, a support at a front portion of the housing, and an adjuster between the housing and the support to selectively adjust the vertical position of the suction nozzle with respect to a surface to be cleaned. The adjuster comprises a ratchet mechanism movably mounted between the support and the housing for movement between a raised and a lowered position, wherein the ratchet mechanism is shaped to raise the housing with respect to the support in the raised position and to lower the housing with respect to the support in the lowered position, and a first actuation rod. A foot pedal is mounted to the housing and incrementally moves the ratchet mechanism between the raised and lowered positions.

DESCRIPTION OF THE PREFERRED EMBODIMENT

Figure 1:
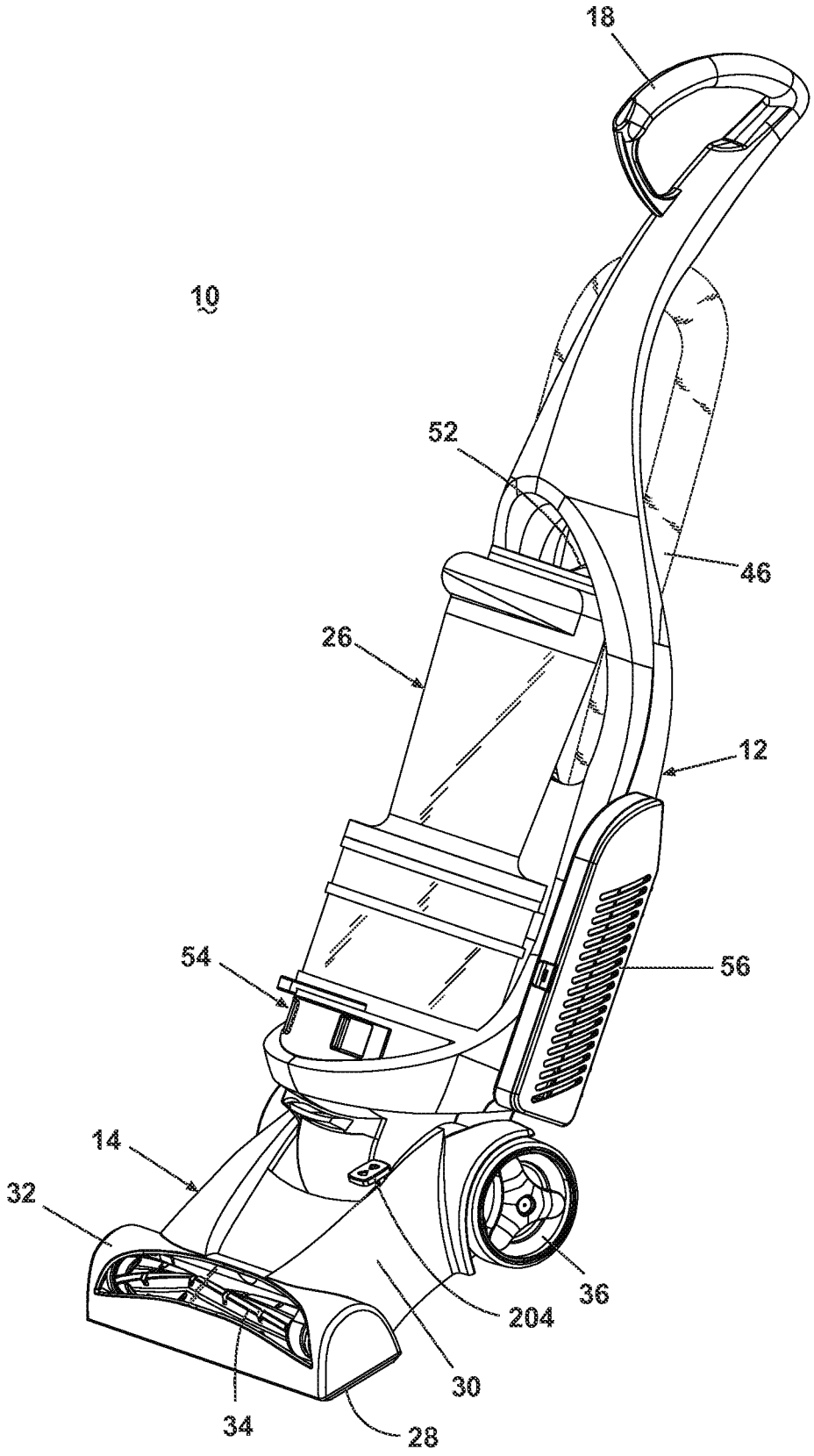
FIG. 1 is a perspective view of an upright vacuum cleaner with a base assembly according to the invention.
Figure 2:
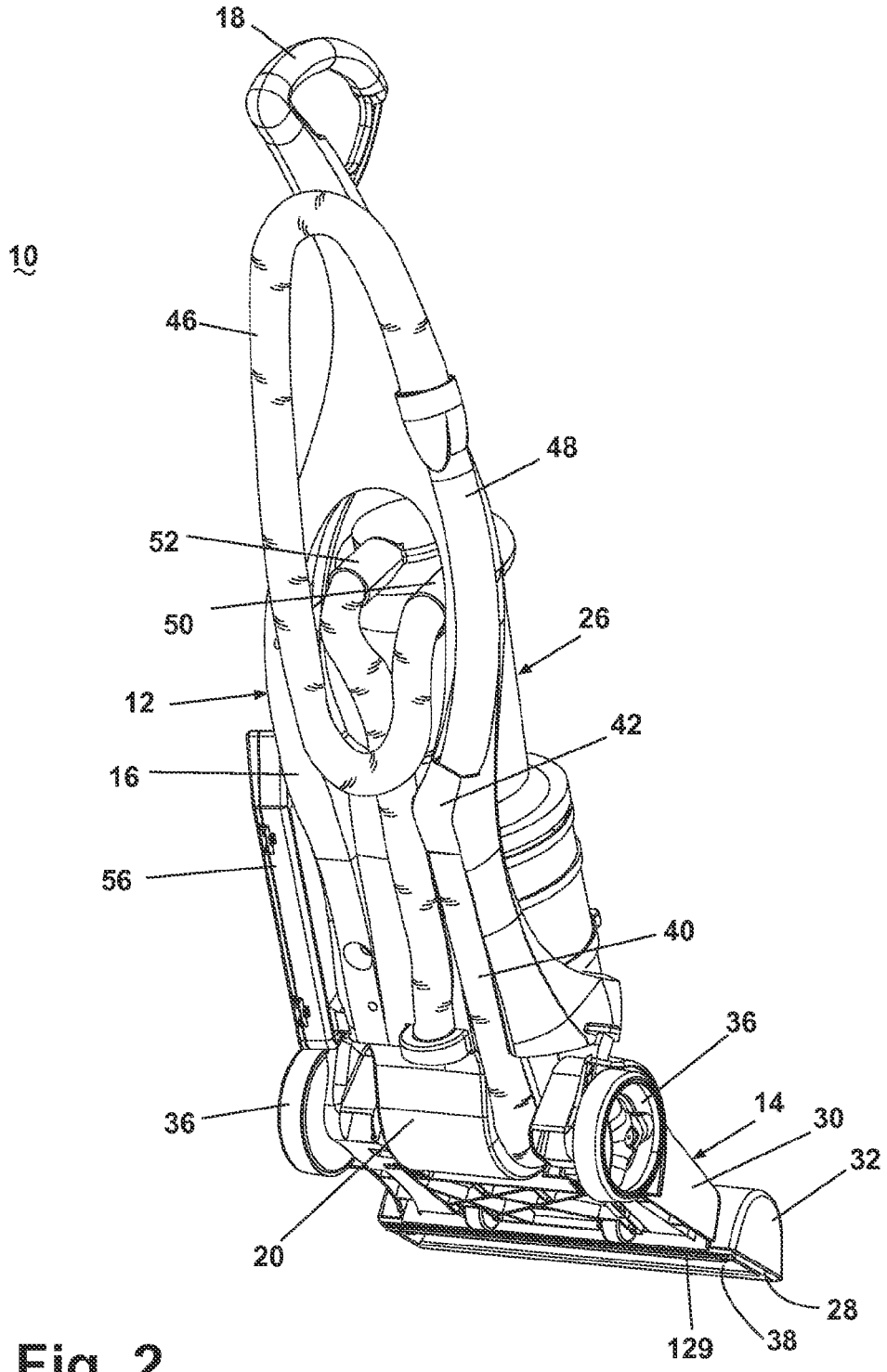
FIG. 2 is a rear quarter perspective view of the upright vacuum cleaner of FIG. 1.
Figure 3:
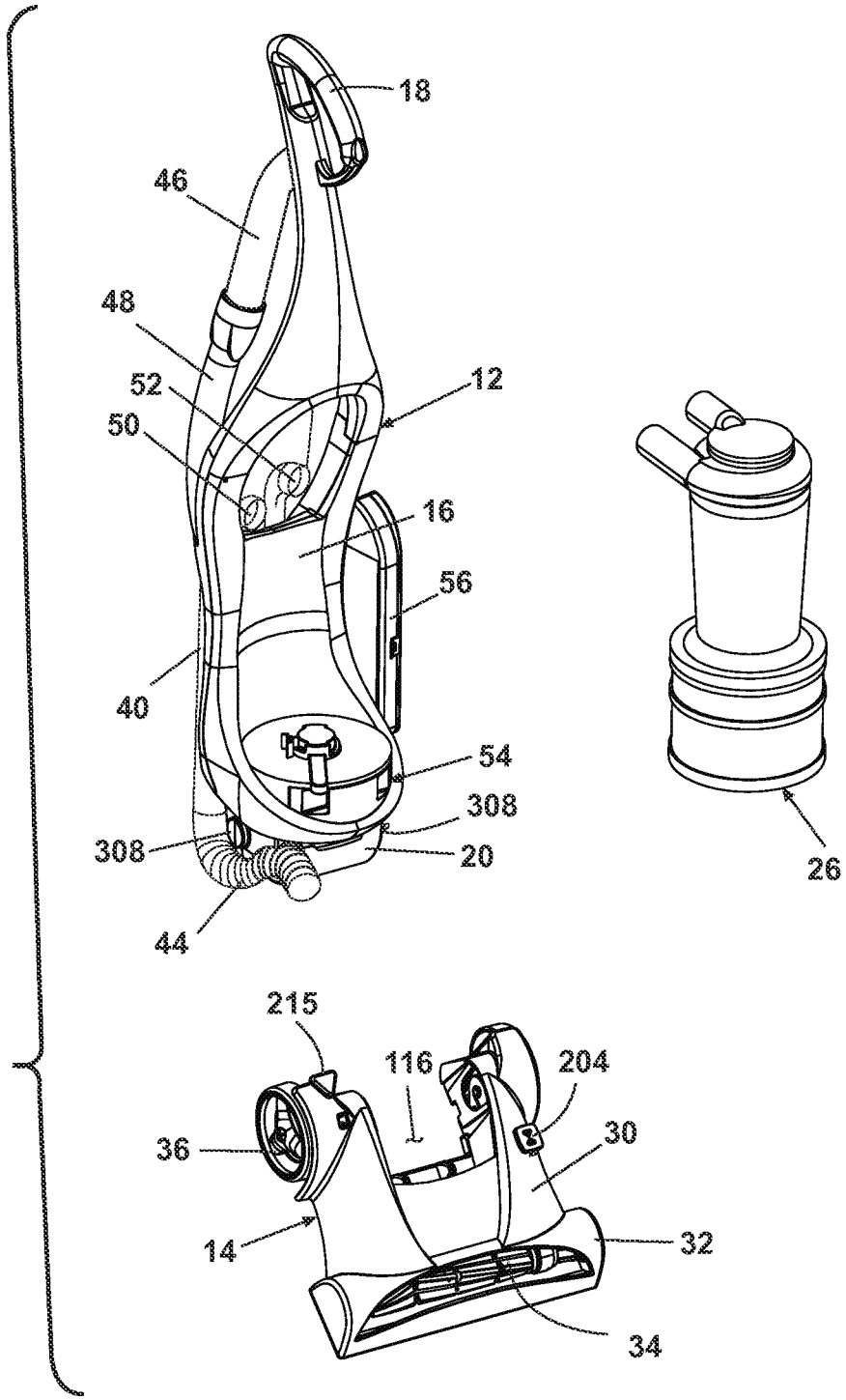
FIG. 3 is an exploded view of the vacuum cleaner from FIG. 1.
Figure 17:
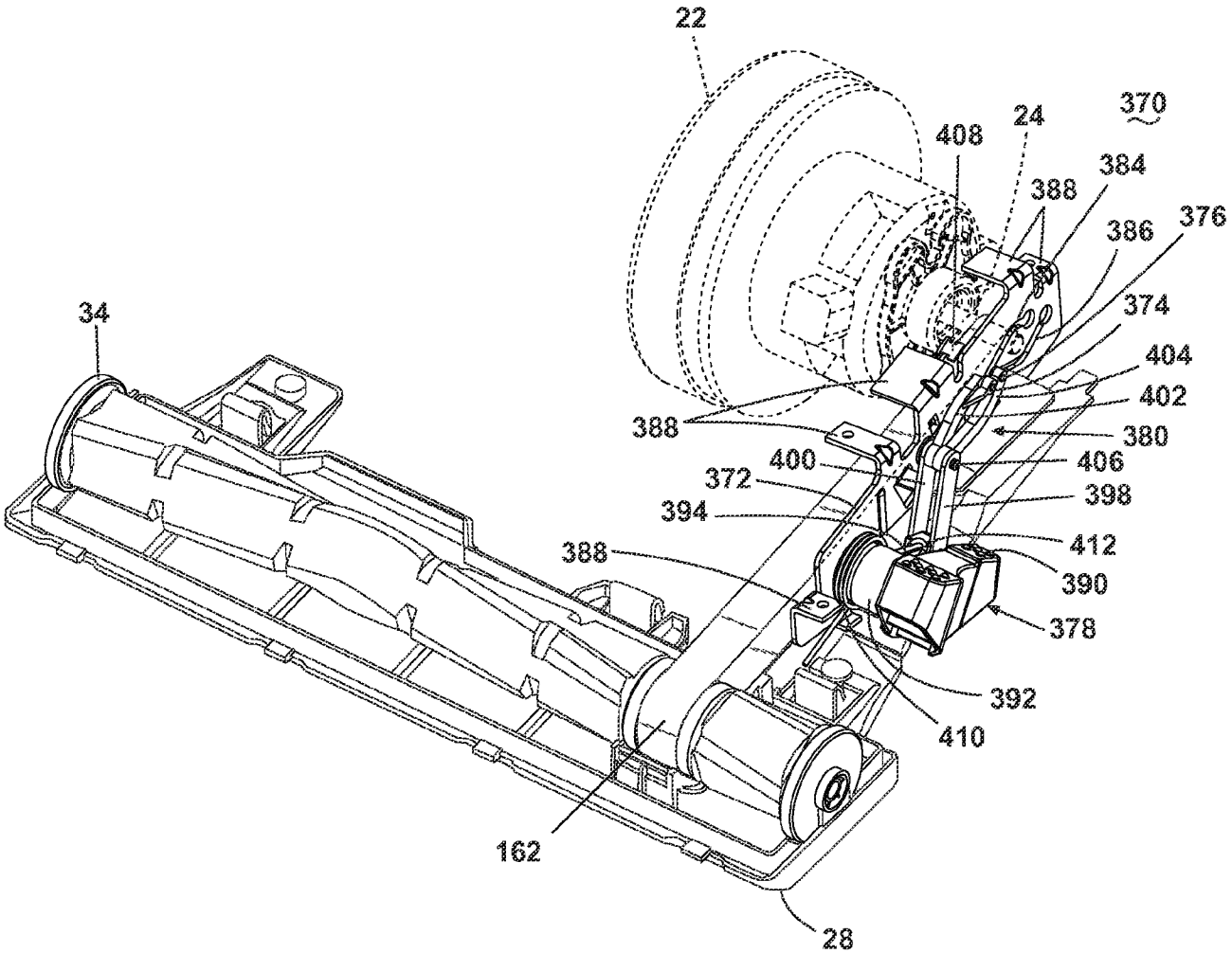
FIG. 17 is a front perspective view of a first alternate drive disengaging mechanism according to the invention.

An exemplary upright vacuum cleaner 10 according to the invention is shown in FIGS. 1-3, and comprises an upright assembly 12 pivotally mounted to a base assembly 14. The upright assembly 14 further comprises a primary support section 16 with a grip 18 on one end to facilitate movement by the user. A motor cavity 20 is formed at an opposite end of the upright assembly 12 and contains a commonly known motor/fan assembly 22 (FIG. 17) oriented transversely therein. The upright assembly 12 pivots relative to the base assembly 14 through an axis formed relative to a shaft 24 (FIG. 9) within the motor/fan assembly. The upright assembly 12 further receives a dirt separation and collection assembly, illustrated as a cyclone separation assembly 26 on the primary support section 16. The cyclone module assembly 26 forms part of a working air path fluidly connecting the base assembly 14 to the motor/fan assembly and separates and collects debris from a working air stream for disposal after the cleaning operation is complete. The details of cyclone separators are known in the vacuum cleaner art and will not be described in detail herein.

The base assembly 14 further comprises a lower housing 28 that mates with an upper housing 30 to form a brush chamber 32 in a forward portion thereon. A rotating brush roll assembly 34 is positioned within the brush chamber 32. A pair of rear wheels 36 is secured to a rearward portion of the base assembly 14, rearward being defined relative to the brush chamber 32. A variety of different base assembly 14 configurations can be assembled to the upright assembly 12 that comprise various features. Typically, the base assembly 14 can vary in width so that the cleaning path can be narrower or wider depending upon the size of the brush chamber 32. A suction nozzle 38 is formed at a lower surface of the brush chamber 32 on the base assembly 14 and is in fluid communication with the surface to be cleaned. A foot conduit 40 provides an air path from the suction nozzle 38 through the base assembly 14 and terminates in a hose grip receiver 42. In the preferred embodiment, the foot conduit 40 is a smooth rigid blow molded tube with a bendable portion 44 that coincides with the pivot point between the base assembly 14 and the upright assembly 12 to allow the upright assembly 12 to pivot with respect to the base assembly 14. In an alternate embodiment, the foot conduit 40 is a commonly known flexible hose typically used in the vacuum cleaner industry. In yet another embodiment, the air path is formed by and between the housings 28, 30 with no secondary blow molded or flexible hose parts.

A live hose 46 terminates in a fixed hose grip 48 on one end and a cyclone inlet receiver 50 on the other end. The live hose 46 is preferably a commonly known flexible vacuum hose. The cyclone inlet receiver 50 is rigidly fixed to an upper portion of the primary support section 16 of the upright assembly 12. The hose grip 48 is removably received in the hose grip receiver 42 via a bayonet latch or, alternatively a friction fit so as to create an air tight seal when the hose grip 48 is inserted therein. The live hose 46 is managed via a pair of commonly known hose hooks (not shown) at a lower portion of the primary support section 16 and near the grip 18 as is commonly known in the vacuum industry.

A cyclone outlet receiver 52 is integrally formed on an upper portion of the primary support section 16 in close proximity to the cyclone inlet receiver 50 and is in fluid communication with a pre-motor filter assembly 54 positioned upstream of an inlet to the motor/fan assembly 22 located in the motor cavity 20. Fluid communication can be accomplished by an air path (not shown) integrally formed in the primary support section 16 or can be a rigid blow molded tube or a commonly known flexible vacuum hose. An outlet of the motor/fan assembly 22 is in fluid communication with a working air exhaust assembly 56. The working air exhaust assembly 56 is positioned adjacent to or may be integral with the primary support section 16, in fluid communication with the exhaust air flow from the motor/fan assembly 22. A variety of commonly known filter elements (not shown) can be utilized in the exhaust assembly 56. In the preferred embodiment, the filter is a commonly known high efficiency particle arrestor (HEPA) filter element.

Figure 4:
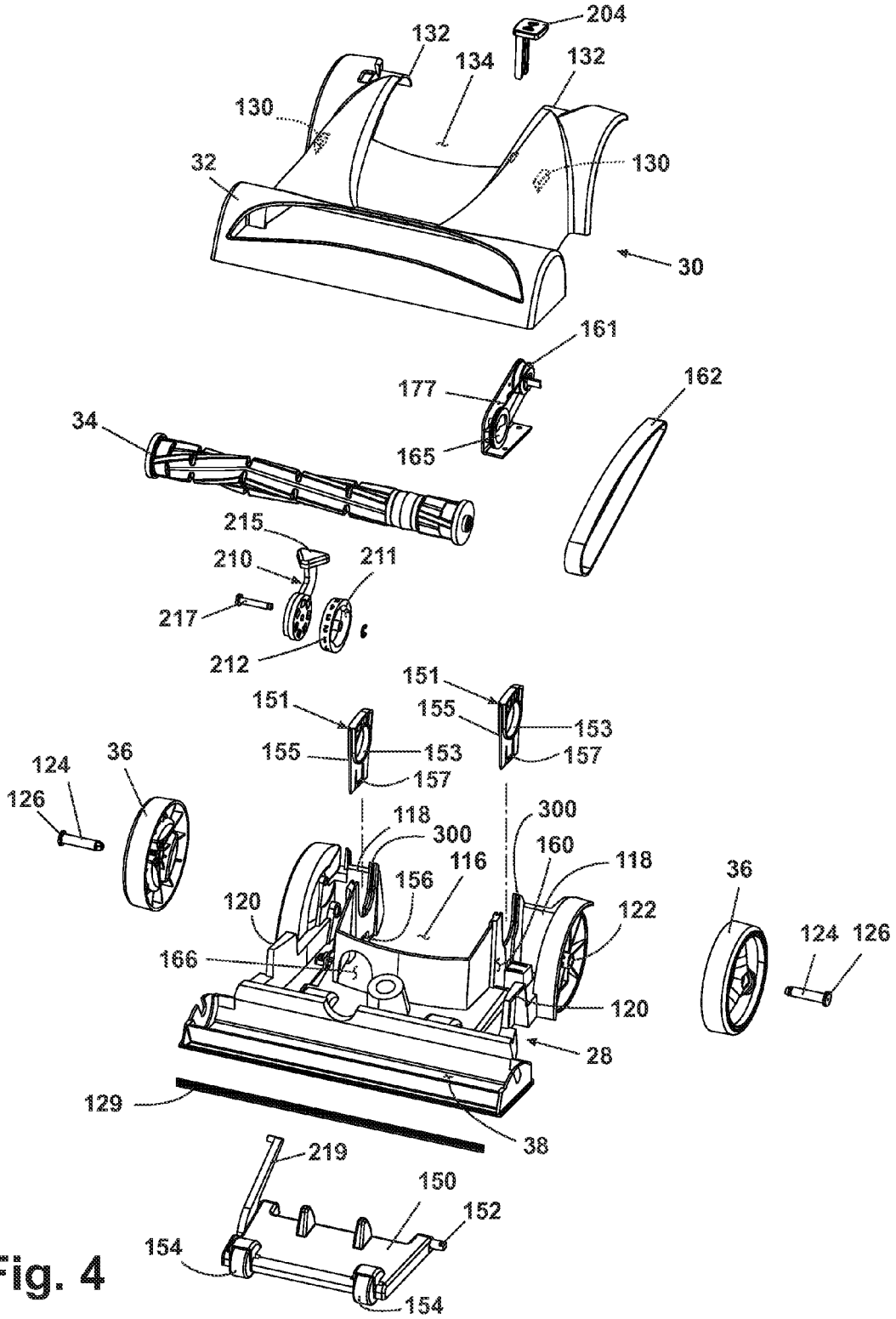
FIG. 4 is an exploded view of the base assembly from FIG. 1.
Figure 5:
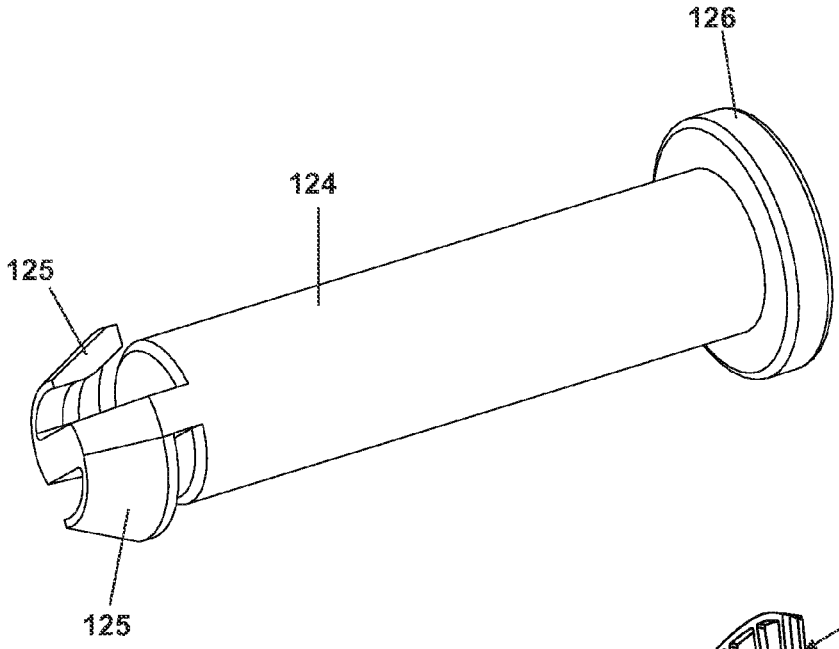
FIG. 5 is a perspective view of a wheel axle shown in FIG. 3.

Referring to FIG. 4, the lower housing 28 further comprises the suction nozzle 38 at a forward end and a handle pivot cavity 116 centrally located on a rearward end relative to the forward end. A plurality of upright retaining tabs 118 are oriented generally orthogonal to the lower housing 28 and on either side of the handle pivot cavity 116, and a pair of retaining tabs 120 are positioned on the side edges of the lower housing 28. A pair of wheel bearings 122 is formed on a side rear edge of the lower housing 28 and fixedly receives a wheel axle 124 upon which the wheel 36 freely rotates. The wheel 36 is captured by a flange 126 on one end of the axle 124. Referring to FIG. 5, the axle 124 is secured in the lower housing 28 via an integrally formed coaxial snap feature comprising a pair of integrally formed resilient engagement members 125 offset axially from the axle 124. The engagement members 125 are tapered relative to the axle 124 shaft to provide a lead in that is self-centering when being inserted into the corresponding wheel bearing 122. In the preferred embodiment, the wheel 36 load is centered longitudinally on the axle 124 so that bending moments on the axle 124 are minimized. Lower bending loads enable the use of smaller diameter axles, which, in the preferred embodiment, are made of a plastic with adequate lubricity. A suitable plastic material is sold by DuPont under the trade name Delrin®. This axle design significantly reduces costs over metal axles that are typically found in vacuum cleaners.

Referring back to FIG. 4, the upper housing 30 further comprises a handle cut out 134 to accommodate rotation of the upright assembly 12 about the motor cavity 20. A plurality of retaining surfaces 132 are formed by apertures in an upper surface of the upper housing 30 that correspond with the upright retaining tabs 118 on the lower housing 28. A pair of engaging tabs 130 are formed on the bottom surface of the upper housing 30 that corresponding to the retaining tabs 120 on the lower housing 28. In operation, the upper housing 30 is oriented at a slight upward angle so that the retaining surfaces 132 engage the retaining tabs 118. The upper housing is then rotated about the retaining surfaces 132 so that the engaging tabs 130 pass over the tabs 120. To remove the upper housing 30, the sides of the upper housing 30 are pulled outward while the upper housing 30 is rotated up and forward about the retaining surfaces 132 until the upper housing 30 can be removed. This design facilitates easy removal of the upper housing 30 for access to the lower housing 28 without the use of tools for routine maintenance. In an alternate embodiment, the upright retaining tabs 118 can be replaced with commonly known ¼ turn fasteners that also facilitate removal of the upper housing 30 without the use of tools.

A belt chamber 160 is also integrally formed in the lower housing 28 and provides a space for a brush belt 162 to mechanically connect the rotating motor shaft 24 with the brush roll assembly 34 positioned in the brush chamber 32 in a conventional manner. A working airflow conduit passage 166 is integrally formed through the lower housing 28 to provide a space for the foot conduit 40 (FIG. 3) to pass therethrough in a conventional manner. In an alternate embodiment, the foot conduit 40 is integrally formed by the upper and lower housings 30, 28 and no additional parts are needed to create the working air flow path through the base assembly 14.

Figure 6:
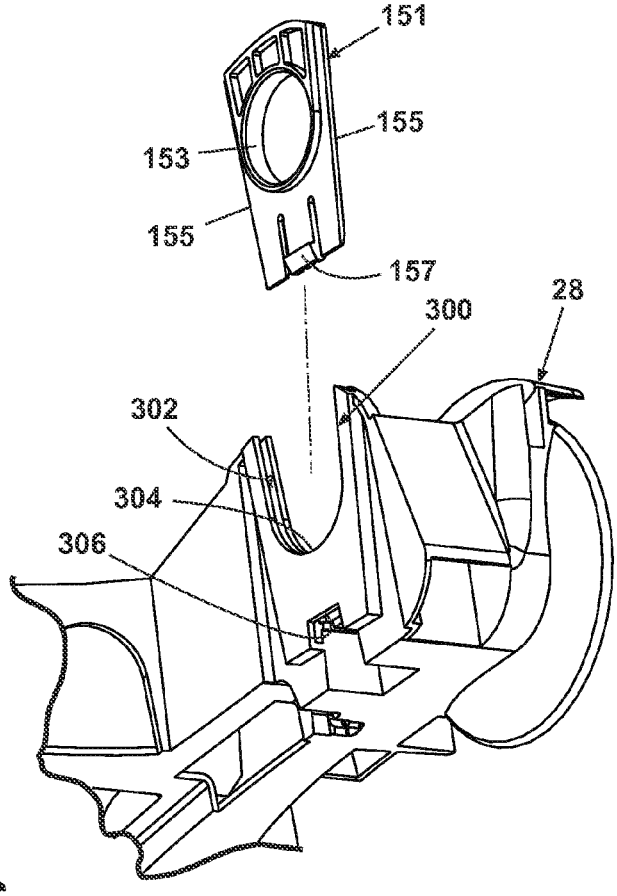
FIG. 6 is an exploded bottom quarter perspective view of a snap in bushing as shown in FIG. 4.

Referring to FIG. 6, the upright assembly 12 is pivotally supported on the base assembly 14 via a pair of snap-in bushings 151. The bushings 151 further comprise a bearing surface 153, a pair of opposed tongues 155, and a resilient snap that includes a lip 157. The lower housing 28 further comprises a bushing support 300 that includes a pair of opposed grooves 302, an arcuate portion 304 that corresponds with the bearing surface 153, and a latch surface 306 that corresponds with the lip 157. To assemble the upright assembly 12 to the base assembly 14, a bushing 151 is placed over a pivot pin 308 (FIG. 3) formed on a lower portion of the upright assembly 12, on either side of the motor cavity 20. Each bushing 151 can be oriented as the upright assembly 12 is moved toward the base assembly 14 so that the tongues 155 engage the grooves 302. The upright assembly 12 is moved downward until the resilient lip 157 passes below the latch surface 306 and snaps in place to capture the bushings 151 on the base assembly 14. As can be appreciated, the snap-in bushings 151 allow the upper housing 30 to be removed without separating the upright assembly 12 from the base assembly 14.

Figure 7:
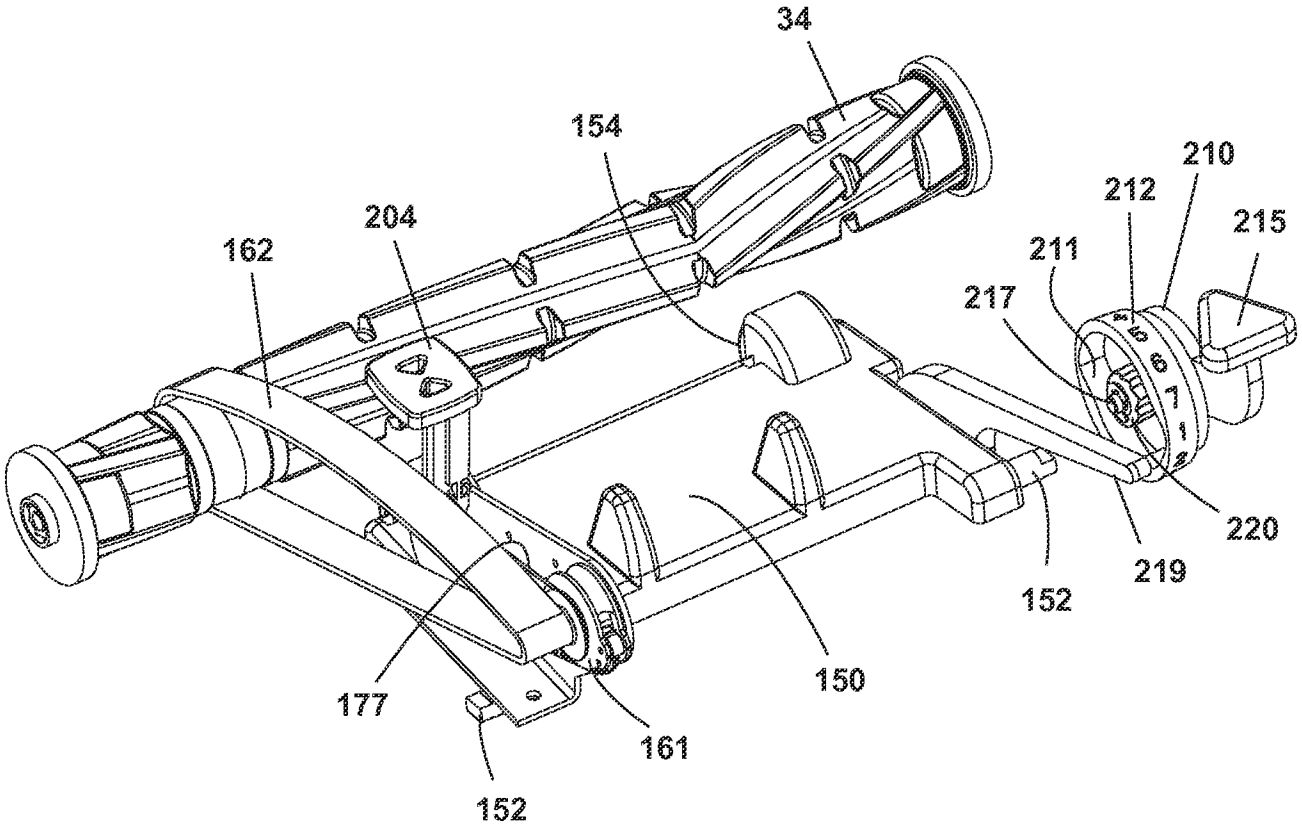
FIG. 7 is a rear left perspective view of a nozzle height adjustment mechanism as shown in FIG. 4.
Figure 8:
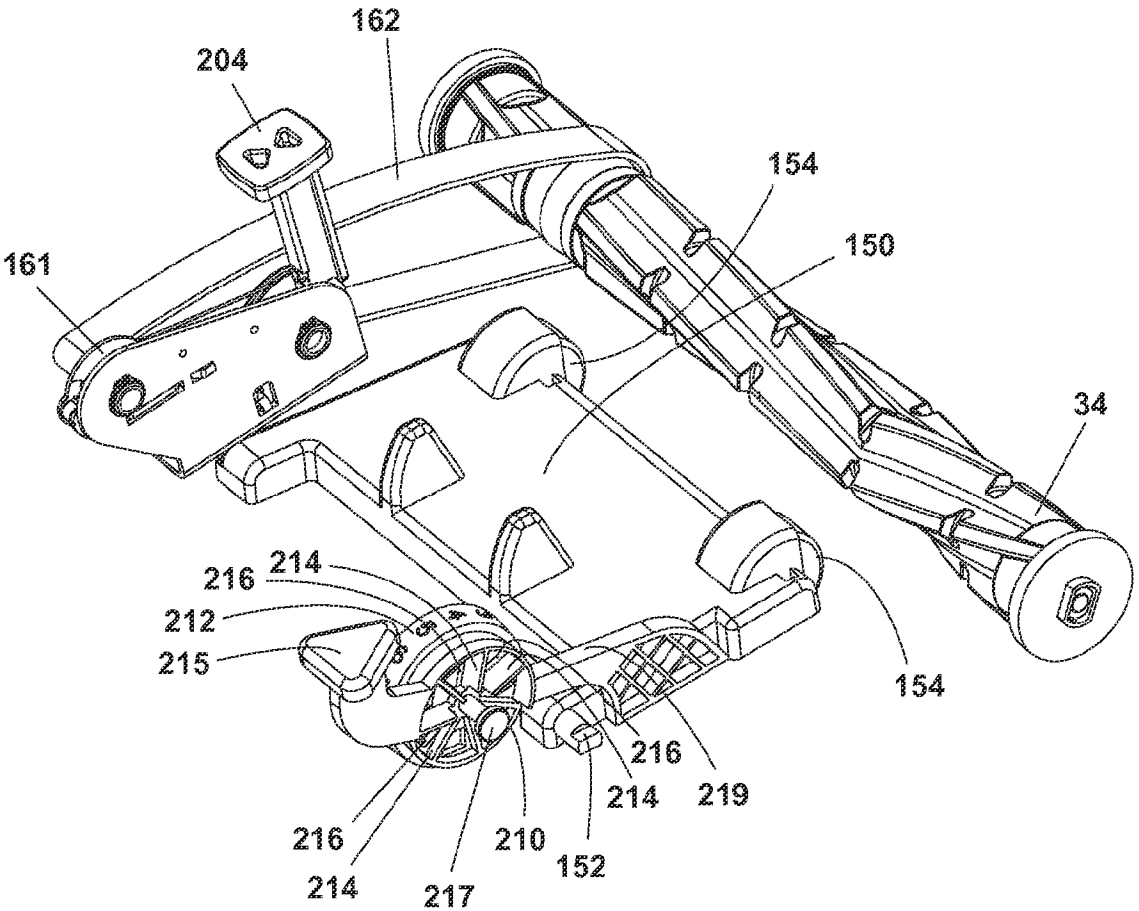
FIG. 8 is a rear right perspective view of the nozzle height adjustment mechanism as shown in FIG. 4.

Referring to FIGS. 7 and 8, a foot-actuated nozzle height adjustment mechanism comprises a carriage assembly 150, an actuator disc 210, a cam disc 212, and a pivot arm 219. The carriage assembly 150 comprises a pivot pins 152 that rotate within a pivot socket 156 integrally molded into the lower housing 28 and a pair of forward freely rotating wheels 154. The actuator disc 210 further comprises a foot pedal 215 and a plurality of resilient ramped surfaces 214 that selectively engage a like number of ramped surfaces 216 on a mating surface of the cam disc 212. Both the actuator disc 210 and cam disc 212 are rotatably affixed to the base 28 via a pin 217 that further keeps the discs 210, 212 in mating contact. A plurality of cam lobes 211 of varying dimensions surround a boss 220 formed on a surface of the cam disc 212 opposite the ramped surfaces 216 for receiving the pin 217. The pivot arm 219 is integrally molded with the carriage assembly 150 and slidingly engages the cam lobes 211 on the inner surface of the cam disc 212.

In operation, the foot pedal 215 is depressed and since it is offset from the pivot pin boss 220, the actuator disc 210 rotates in a counterclockwise direction (when viewed from the perspective of FIG. 8) which, in turn, rotates the cam disc 212 via the mating ramped surfaces 214, 216. As the cam disc 212 rotates, the cam lobes 211 move past the pivot arm 219 and the pivot arm 219 comes to rest in the next cam lobe recess formed between two cam lobes 211. Since the cam lobes 211 vary in height, the carriage assembly 150 rotates about the pivot axis 152 causing the wheels 154 move either away from or towards a bottom surface of the lower housing 28. When the foot pedal 215 is released, the pivot arm 219 holds the cam disc 212 in place and a torsion spring (not shown) forces the actuator disc 210 in a clockwise direction whereby the resilient ramped surfaces 214 slide past the cam ramped surfaces 216 and come to rest in mating relation with the next ramped surface 214.

Figure 8A:
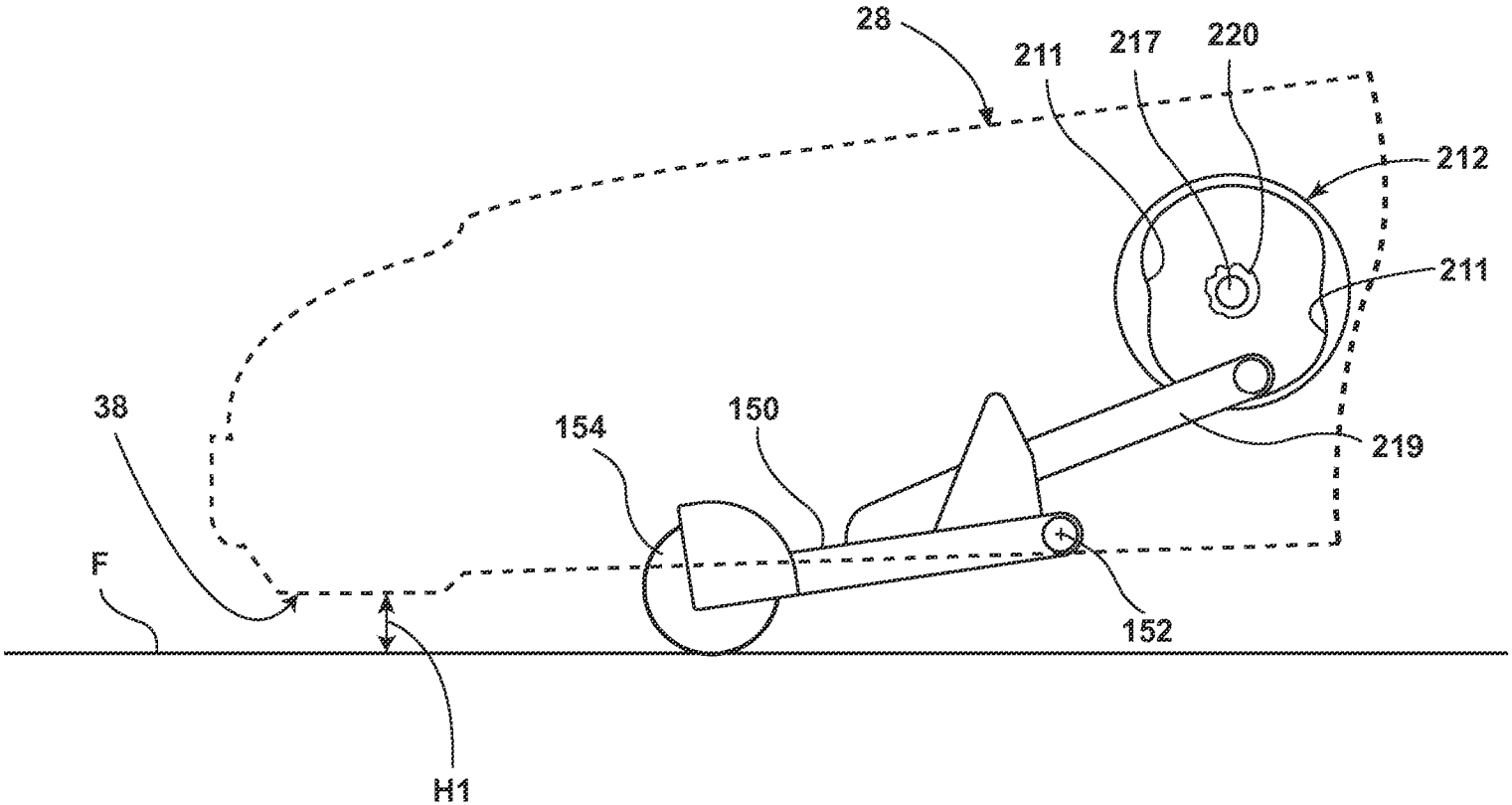
FIG. 8A-B are schematic side views of the operation of the nozzle height adjustment mechanism from FIGS. 4, 7, and 8.
Figure 8B:
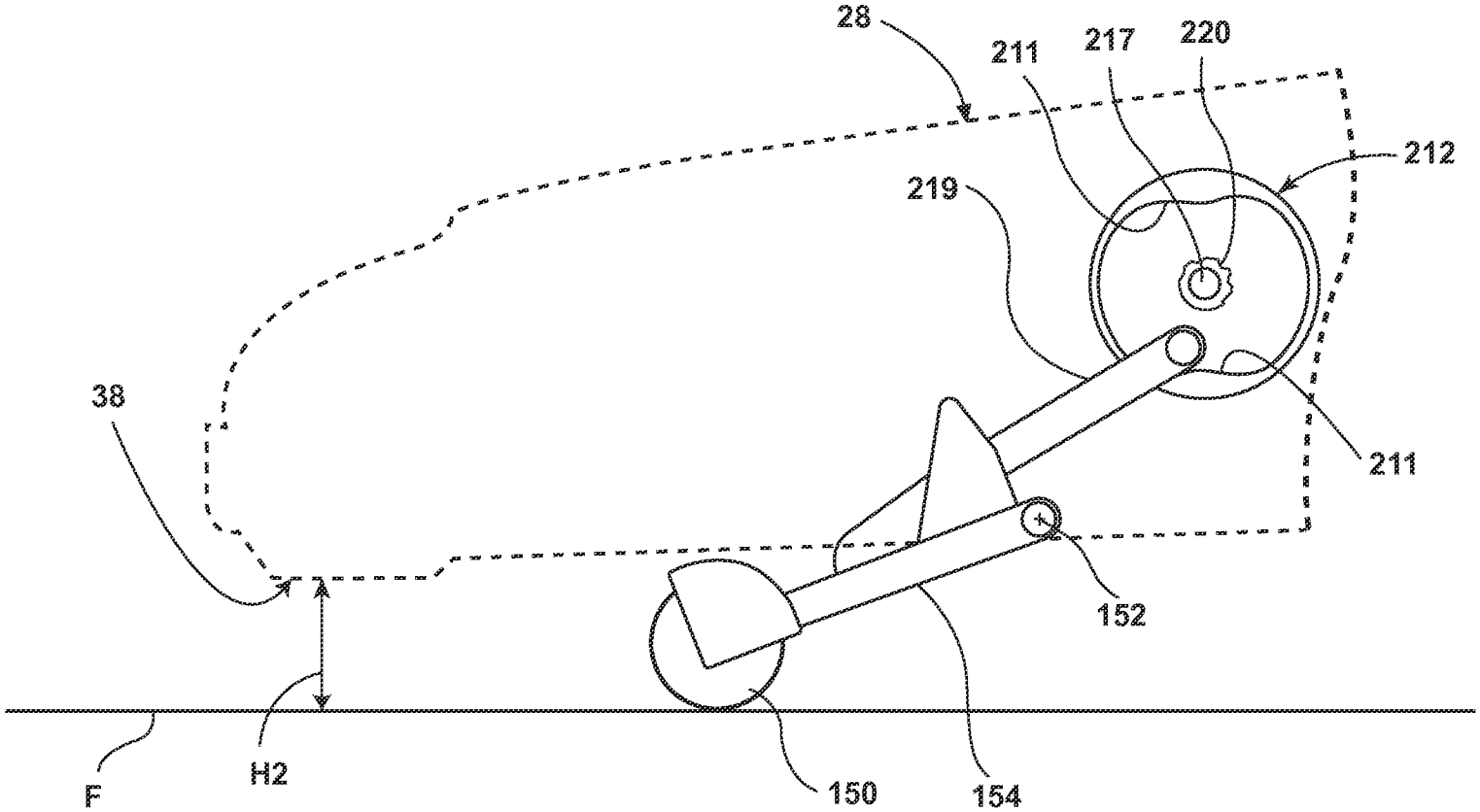

FIGS. 8A-B are schematic side views of the operation of the nozzle height adjustment from FIGS. 4, 7, and 8. Actuation of the nozzle height adjustment mechanism results in changing the position of the carriage assembly 150 relative to the lower housing 28. Specifically, the pivot pins 152 act as a fixed fulcrum point about which the carriage assembly 150 rotates, with the pivot arm 219 and the wheels 154 having a fixed angular relationship to each other. The pivot arm 219 is similar to a lever, in that changing the position of the pivot arm 219 (which is dependent on which cam lobe recess formed between two adjacent cam lobes 211 the pivot arm 219 is in) results in changing the position of the wheels 154. Movement of the wheels 154 away from or towards a bottom surface of the lower housing 28 raises or lowers the front portion of the lower housing 28 relative to a floor surface F, which necessarily adjusts the height of the suction nozzle 38 relative to the floor surface F. FIGS. 8A-8B show the movement of the nozzle height adjustment between a first lowered position in which the suction nozzle 38 is at a height H1 from the floor surface F (FIG. 8A) and a second raised position in which the suction nozzle 38 is at a greater height H2 from the floor surface F (FIG. 8B).

Figure 9:
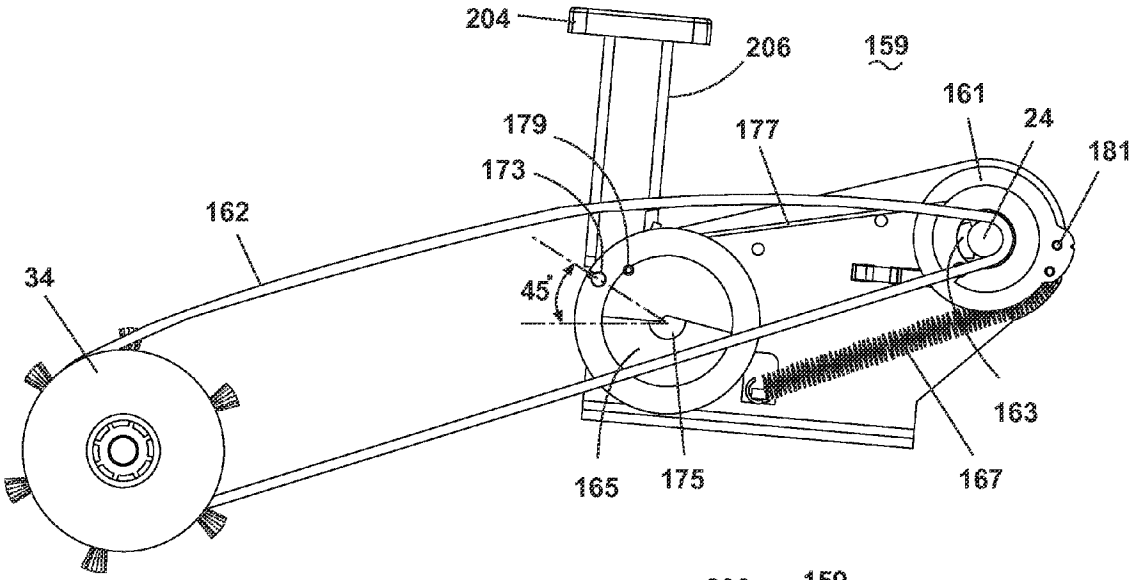
FIG. 9 is a schematic view of a drive disengaging device shown in FIG. 4, illustrating the belt engaged with the brush.
Figure 10:
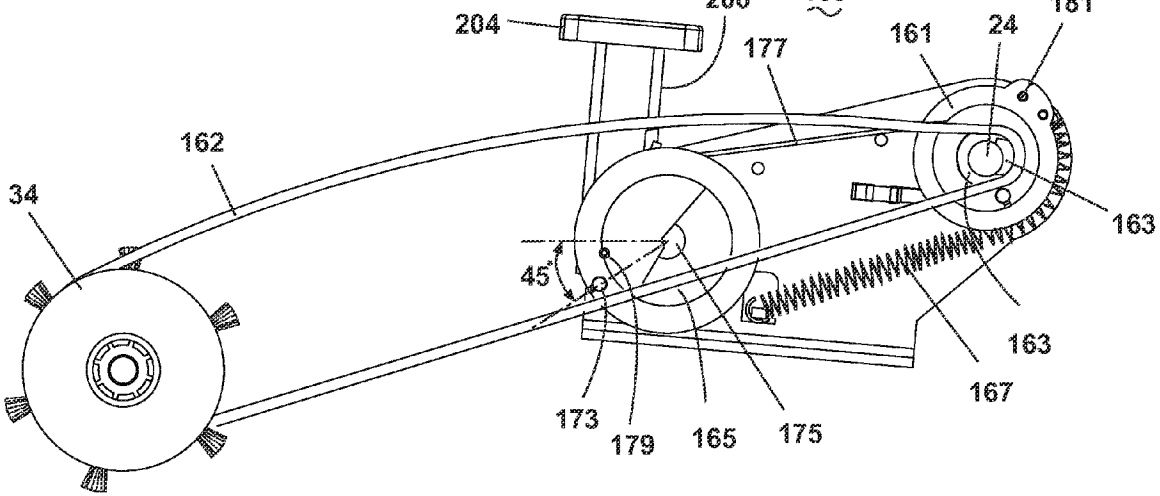
FIG. 10 is a schematic view of a drive disengaging device shown in FIG. 4, illustrating the belt disengaged from the brush.

Referring to FIGS. 9 and 10, a belt or drive disengaging device 159 comprises a first plate 161 that is mounted for rotation about the motor cavity 20 having motor shaft 24 extending therethrough. A crescent shaped bearing surface 163 is attached in an offset fashion to the first plate 161. A spring 167 is connected at one end to the first plate 161 and at the other end to a location on the base assembly 14 to bias the belt disengaging device 159 to an engaged position. A second plate 165 is mounted for rotation about a pivot pin 175 attached to the lower housing 28 and has an engagement pin 173 extending orthogonally therefrom. The second plate 165 is biased in a counterclockwise direction as viewed in FIG. 9 by a spring strap 177 that is fixed at one end to the periphery of the second plate 165 through pin 179 and at the other end to the periphery of the first plate 161 through a pin 181. The spring strap 177 is weaved between the two plates 161, 165 so that the two plates 161, 165 move in an interrelated fashion. A foot pedal 204 for actuating the belt disengaging device 159 is provided on the exterior of the base assembly 14 and comprises a shaft 206 that extends through the upper housing 28 for engagement with the engagement pin 173. With the belt disengaging device 159 in the position shown in FIG. 9, the crescent surface 163 is generally positioned between the motor shaft 24 and the brush roll assembly 34 so that the belt 162 rides on the motor shaft 24 and drives the brush roll assembly 34. Referring to FIG. 10, when pressure is applied to the foot pedal 204, the shaft 206 moves linearly in a substantially vertical direction such that the engagement pin 173 is forced downwardly. The downward force overcomes the spring bias and rotates the second plate 165 approximately 90 degrees in a counterclockwise direction. The interconnection of the first and second plates 161, 165 provided by the spring strap 177 causes the first plate 161 to rotate approximately 90 degrees in a counterclockwise direction. As the first plate 161 is rotated, the crescent bearing surface 163 rotates into contact with and slightly stretches the belt 162 away from the shaft 24 until the shaft 24 is between the crescent bearing surface 163 and the brush roll assembly 34, effectively disengaging the brush roll assembly 34. A detent device (not shown) maintains the pedal 204 in the depressed position shown in FIG. 10 and thus maintains the belt disengaging device 159 in the disengaged position. To engage the brush roll assembly 34, the foot pedal 204 is again depressed to release the first plate 161 back to the original position.

Figure 11:
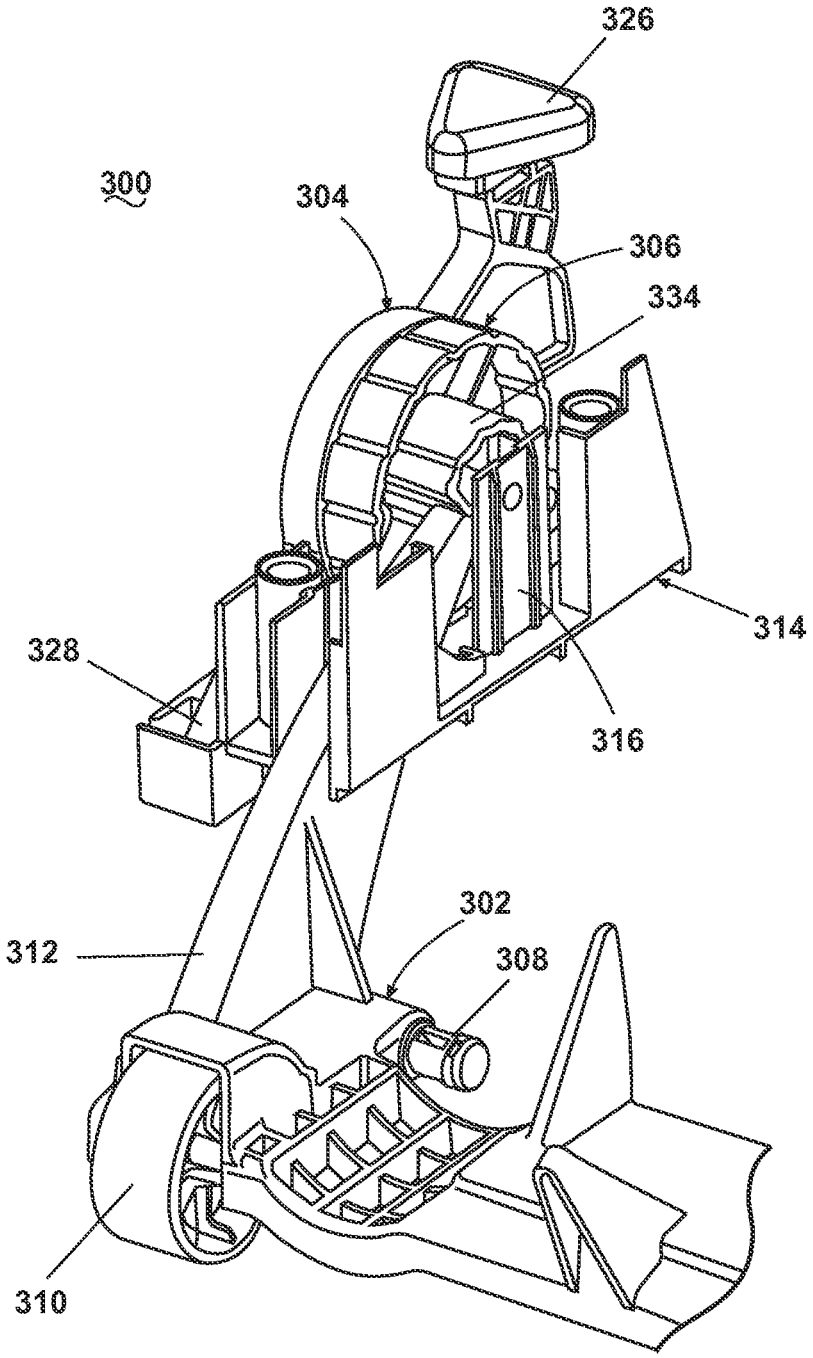
FIG. 11 is a rear left perspective view of a first alternate nozzle height adjustment mechanism according to the invention.
Figure 12:
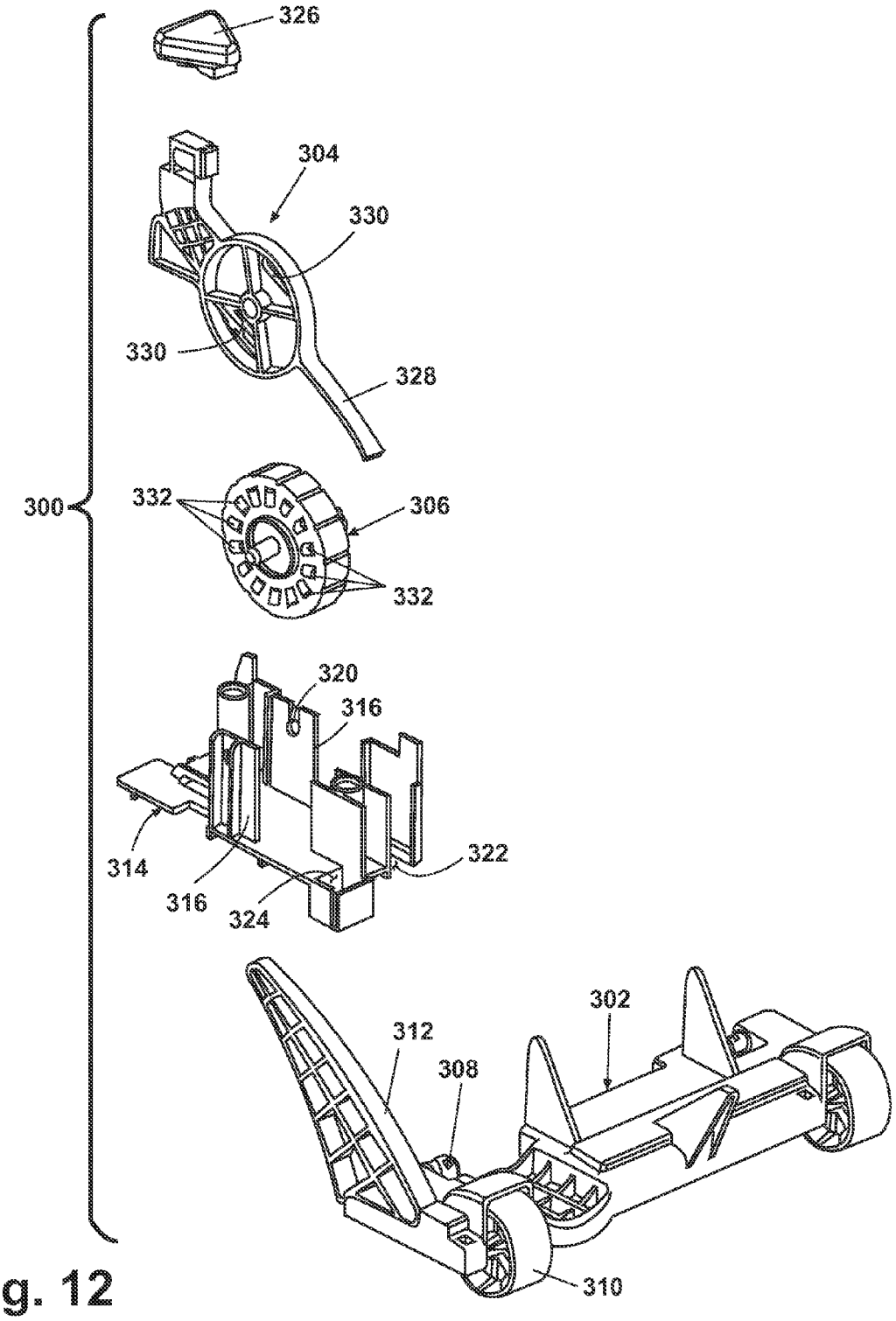
FIG. 12 is a rear right perspective view of the nozzle height adjustment mechanism shown in FIG. 11.

While the base assembly 14 is illustrated as comprising the nozzle height adjustment mechanism shown in FIGS. 7 and 8, other adjustment mechanisms can be used and a few examples of alternate embodiments of suitable nozzle height adjustment mechanisms are illustrated in FIGS. 11-16. Referring to FIGS. 11 and 12, a first alternate embodiment 300 comprises a carriage assembly 302, an actuator disc 304, and a cam disc 306. The carriage assembly 300 is pivotally connected to the lower housing 28 through a pivot axis 308 and comprises a pair of wheels 310 and a pivot arm 312. The actuator disc 304 and cam disc 306 are received in a bracket 314 affixed within the base assembly 14 such that the discs 304, 306 are kept in mating contact. The bracket 314 comprises two upstanding portions 316, between which the actuator disc 304 and cam disc 306 are mounted by inserting a pin 318 or other suitable fastener through a pair of aligned holes 320, a pivot arm slot 322, and a spring arm slot 324. The actuator disc 304 further comprises a foot pedal 326, a spring arm 328 and a pair of resilient ramped surfaces 330 that selectively engage a plurality of generally rigid ramped surfaces 232 on a mating surface of the cam disc 306. On the side of the cam disc 306 opposite the ramped surfaces 232, a plurality of cam lobes 334 of varying dimensions surround a boss 336 for receiving pin 318. The pivot arm 312 engages the cam lobes 334 on the cam disc 306. The spring arm 328 is received in the spring arm slot 324 and biases the actuator disc in a counterclockwise direction with respect to the orientation of FIG. 11. In operation, the foot pedal 326 is depressed and the actuator disc 304 rotates in a clockwise direction with respect to the orientation of FIG. 11 which, in turn, rotates the cam disc 306 via the mating ramped surfaces 330, 332. As the cam disc 306 rotates, the cam lobes 334 move past the pivot arm 312 and the pivot arm 312 comes to rest in the next cam lobe recess formed between two cam lobes 334. Since the cam lobes 334 vary in height, the carriage assembly 302 rotates about the pivot axis 308, causing the wheels 310 move either away from or towards a bottom surface of the lower housing 28. When the foot pedal 326 is released, the pivot arm 312 holds the cam disc 306 in place and the spring arm 328 forces the actuator disc 304 in a clockwise direction whereby the resilient ramped surfaces 330 slide past the rigid ramped surfaces 332 and come to rest in mating relation with the next ramped surface 332.

Figure 13:
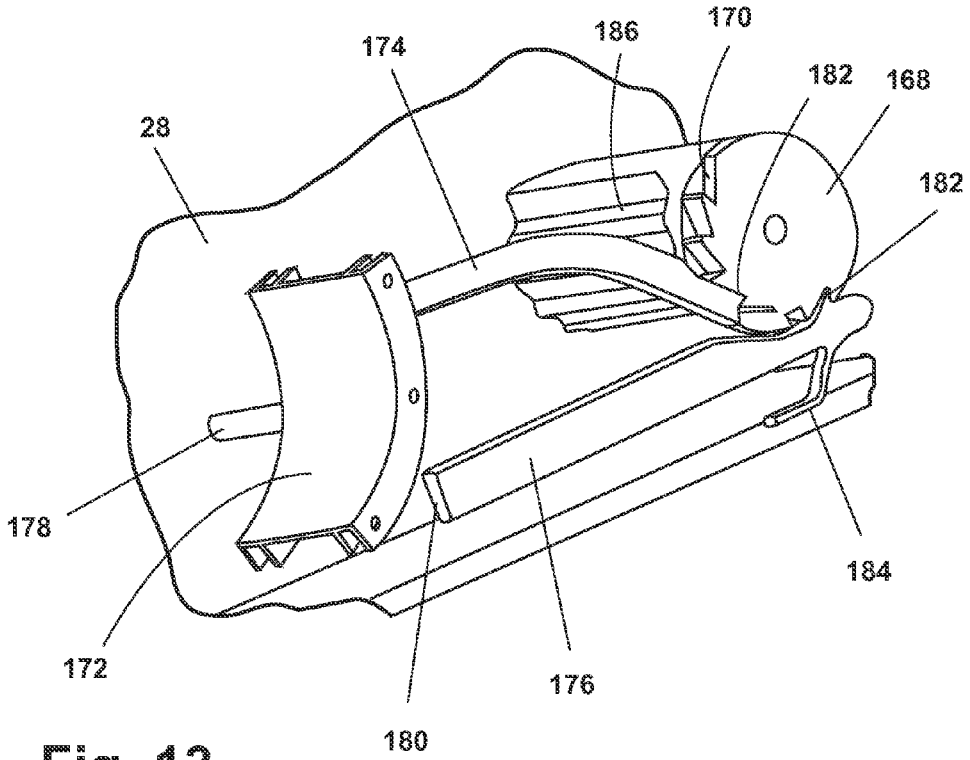
FIG. 13 is a cut-away perspective view of a second alternate nozzle height adjustment mechanism according to the invention.

Referring to FIG. 13, a second alternate embodiment of a nozzle height adjustment mechanism comprises a rotating drum 168 with a plurality of ratcheted detents 170, a foot pedal 172, a down actuator rod 174, and an up actuator rod 176. The drum 168 and the foot pedal 172 both rotate about separate bearing surfaces integrally molded in the lower housing 28. The foot pedal 172 is pivotally mounted on a pin 178. Both the up and down actuator rods 174, 176 further comprise a pedal engagement surface 180 on one end and a ratchet engagement surface 182 on the other. The up actuator rod 176 further comprises a spring member 184 that biases the rod 176 into engagement with the ratchet detents 170. The down actuator rod 174 is rotatably attached to an upper end of the foot pedal 172. A plurality of steps 186 are formed on the surface of the drum 168 adjacent the ratchet detents 170 and engage with the carriage assembly 150 (FIG. 4) as previously described. More specifically, as shown in FIG. 13A-B, the pivot arm 219 of the carriage assembly 150 can engage one of the steps 186, just as the pivot arm 219 engaged one of the cam lobes 211 as shown in FIG. 8A.

In operation, an upper portion of the foot pedal 172 is pressed, and the foot pedal pivots about the pin 178, thereby displacing the down actuator rod 174 and forcing the ratchet engagement surface 182 into the ratchet detent 170. This causes the drum 168 to rotate in a counterclockwise direction whereby the ratchet engagement surface 182 on the up actuator rod 176 rides over the ratchet detent 170 until the up actuator rod 176 clears the ratchet detent 170 and the spring member 184 forces the ratchet engagement surface 182 on the up actuator rod 176 into the next ratchet detent 170. This action rotates the drum 168 the distance of one ratchet detent 170, which displaces the step 186 and moves the carriage assembly 150 closer to the bottom surface of the lower housing 28 to reduce the nozzle height above the surface to be cleaned. Conversely, when the lower surface of the foot pedal 172 is depressed, the foot pedal 172 pushes the up actuator rod 176 to release engagement surface 182 and pulls the down actuator rod 174 away from the ratchet detents 170 so that the drum 168 rotates in an opposite direction. The steps 186 then push the carriage assembly 150 away from the bottom surface of the lower housing 28 to increase the nozzle height above the surface to be cleaned. In this way, nozzle height can be adjusted incrementally in either direction as desired.

Figure 13A:
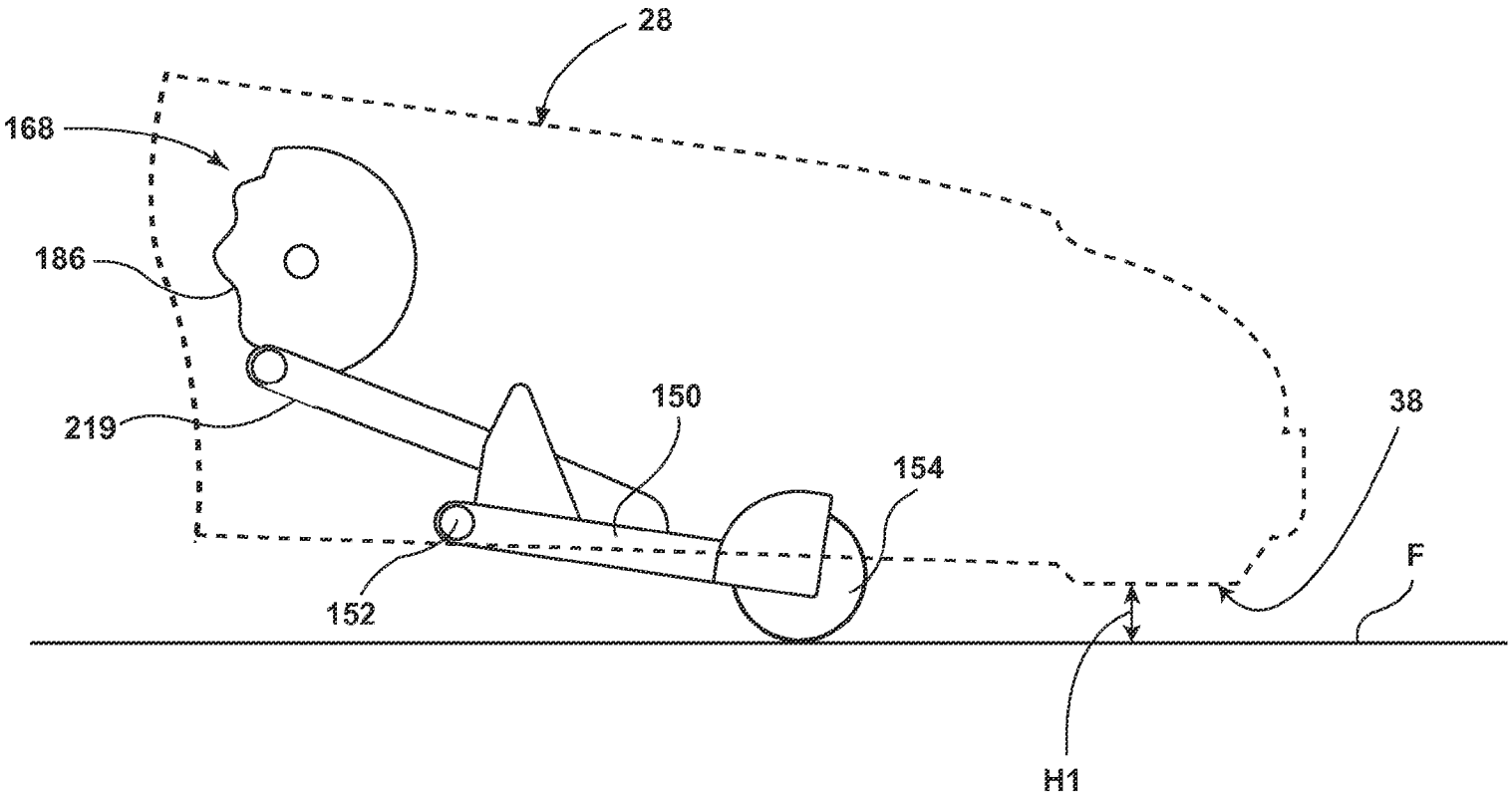
FIGS. 13A-B are schematic side views of the operation of the second alternate nozzle height adjustment mechanism from FIG. 13.
Figure 13B:
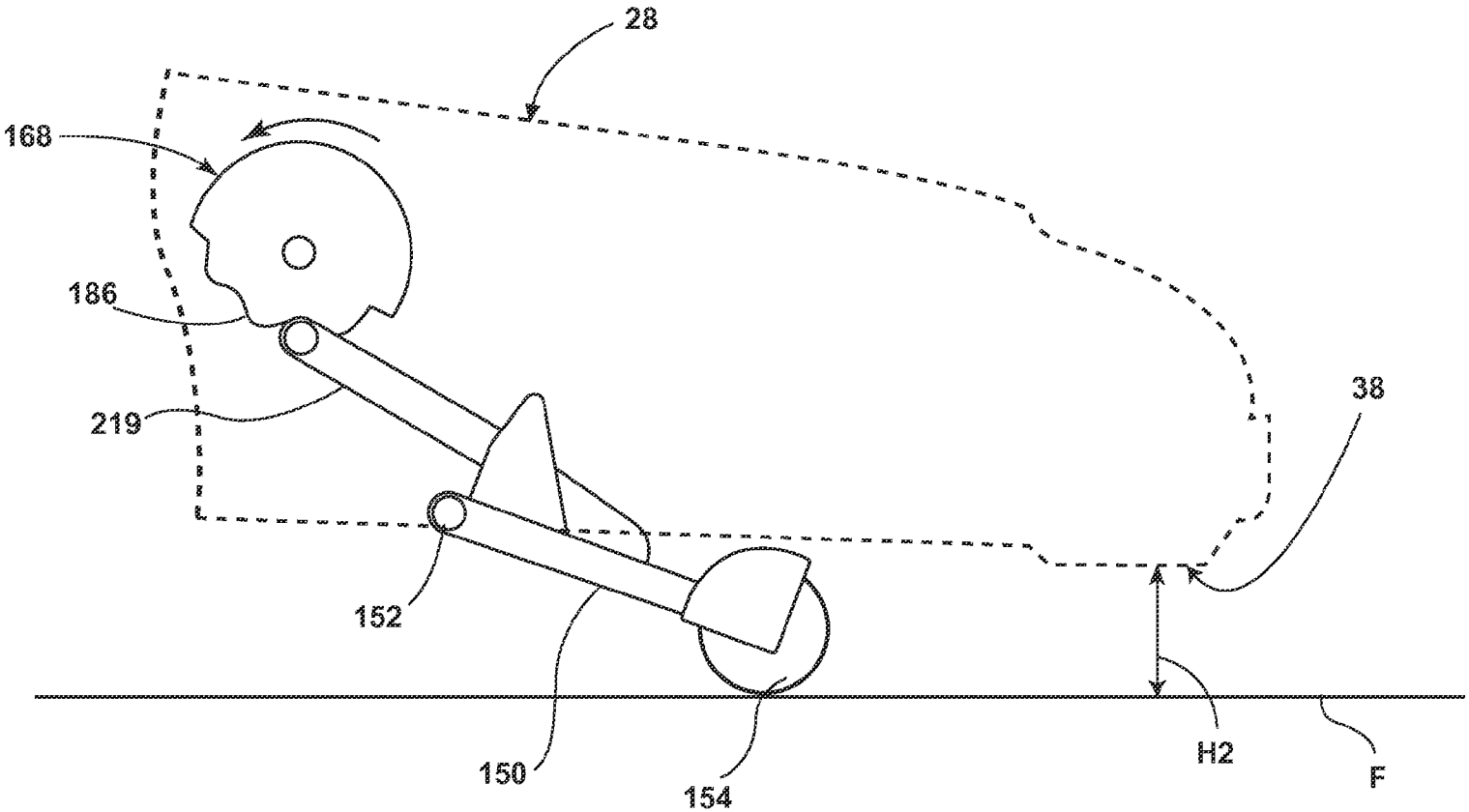

FIGS. 13A-B are schematic side views of the operation of the second alternate nozzle height adjustment mechanism from FIG. 13. Actuation of the nozzle height adjustment mechanism results in changing the position of the carriage assembly 150 relative to the lower housing 28. Specifically, the pivot pins 152 act as a fixed fulcrum point about which the carriage assembly 150 rotates, with the pivot arm 219 and the wheels 154 having a fixed angular relationship to each other. The pivot arm 219 is similar to a lever, in that changing the position of the pivot arm 219 (which is dependent on which step 186 the pivot arm 219 is in) results in changing the position of the wheels 154. Movement of the wheels 154 away from or towards a bottom surface of the lower housing 28 raises or lowers the front portion of the lower housing 28 relative to a floor surface F, which necessarily adjusts the height of the suction nozzle 38 relative to the floor surface F. FIGS. 13A-B shows the movement of the nozzle height adjustment between a first lowered position (FIG. 13A) in which the suction nozzle 38 is at a height H1 from the floor surface F and a second raised position (FIG. 13B) in which the suction nozzle 38 is at a greater height H2 from the floor surface F. In the first lowered position of FIG. 13A, the pivot arm 219 engages a first step 186 on the drum 168. To move to the second raised position of FIG. 13B, the foot pedal 172 is pressed as described above with respect to FIG. 13, which causes the drum 168 to rotate in a counterclockwise direction and move the pivot arm 219 from one step 186 to the next adjacent step 186. The steps 186 can have different dimensions, such that movement between steps changes the angular position of the pivot arm 219, thereby raising or lowering the wheel 154 relative to the lower housing 28.

Figure 14:
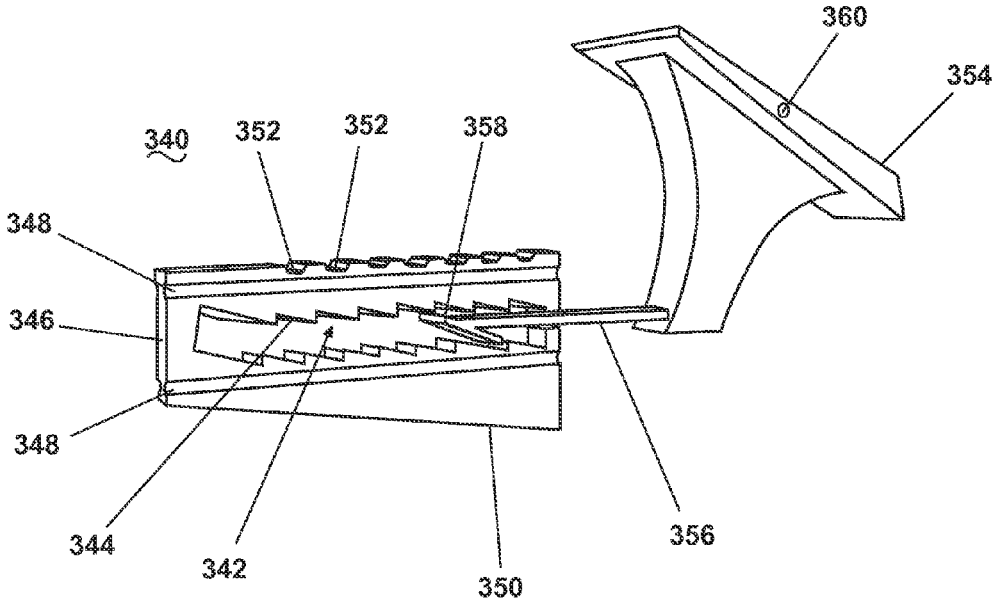
FIG. 14 is a cut-away perspective view of a third alternate nozzle height adjustment mechanism according to the invention.

Referring to FIG. 14, a third alternate embodiment of a nozzle height adjustment mechanism is illustrated, and comprises a ratcheting nozzle height adjustment mechanism 340. The height adjustment mechanism 340 comprises a linear track 342 with a plurality of ratchet detents 344 formed within a trapezoidal housing 346. A pair of grooves 348 run along either side of the linear track 342. Both the linear track 342 and the grooves 348 are aligned parallel to an upper surface of the trapezoidal housing 346, leaving a ramped engagement surface 350 at a lower surface. A plurality of detents 352 are equally spaced along the upper surface of the trapezoidal housing 346 and slideably engage a resilient tab (not shown) on the lower housing 28. The trapezoidal housing 346 is slideably affixed to the lower housing 28 in a horizontal orientation via the grooves 348 so that the upper surface travels in a generally horizontal plane relative to the surface to be cleaned. A two position foot pedal 354 is pivotally affixed to the lower housing 28 by a pin 360 and acts on an actuation rod 356 with a corresponding ratchet engagement surface 358.

The operation is similar to the second alternate embodiment shown in FIG. 13, wherein when either the upper portion or the lower portion of the foot pedal 354 is pressed, the ratchet engagement surface 358 respectively engages either the upper or lower set of ratchet detents 344 formed on the linear track 342 and pushes the trapezoidal housing 346 relative to the lower housing 28 along the grooves 348 until one of the detents 352 is captured by the resilient tab on the lower housing 28, which forces the ratchet engagement surface 358 into the next ratchet detent 344. Since the movable ramped engagement surface 350 directly engages the pivoting height adjustment carriage assembly 150 shown in FIG. 4, as the trapezoidal housing 346 moves horizontally, the carriage assembly 150 is forced away from or up towards the bottom surface of the lower housing 28 to effectively raise and lower the nozzle height above the surface to be cleaned.

Figure 14A:
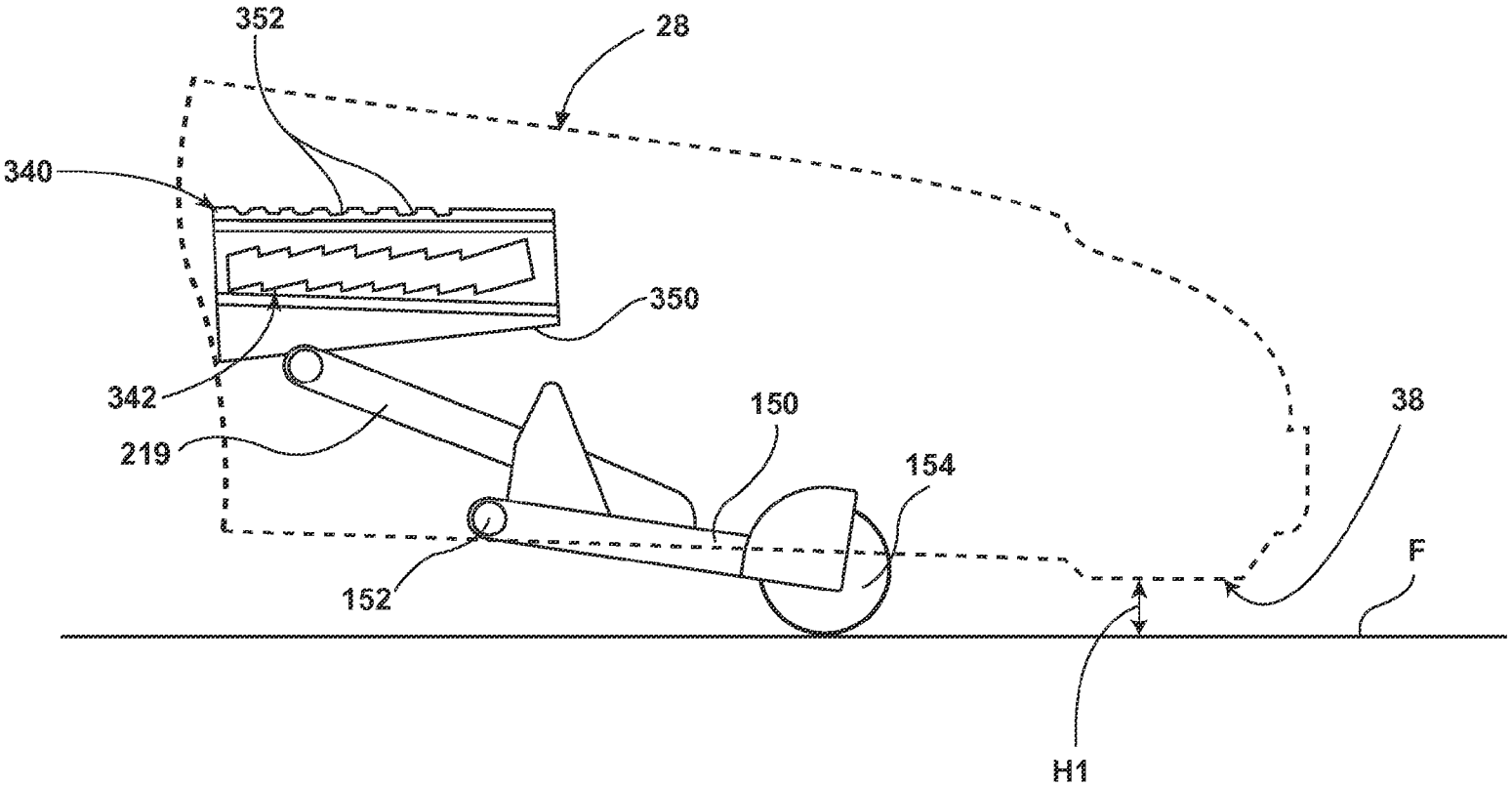
FIGS. 14A-B are schematic side views of the operation of the third alternate nozzle height adjustment mechanism from FIG. 14.
Figure 14B:
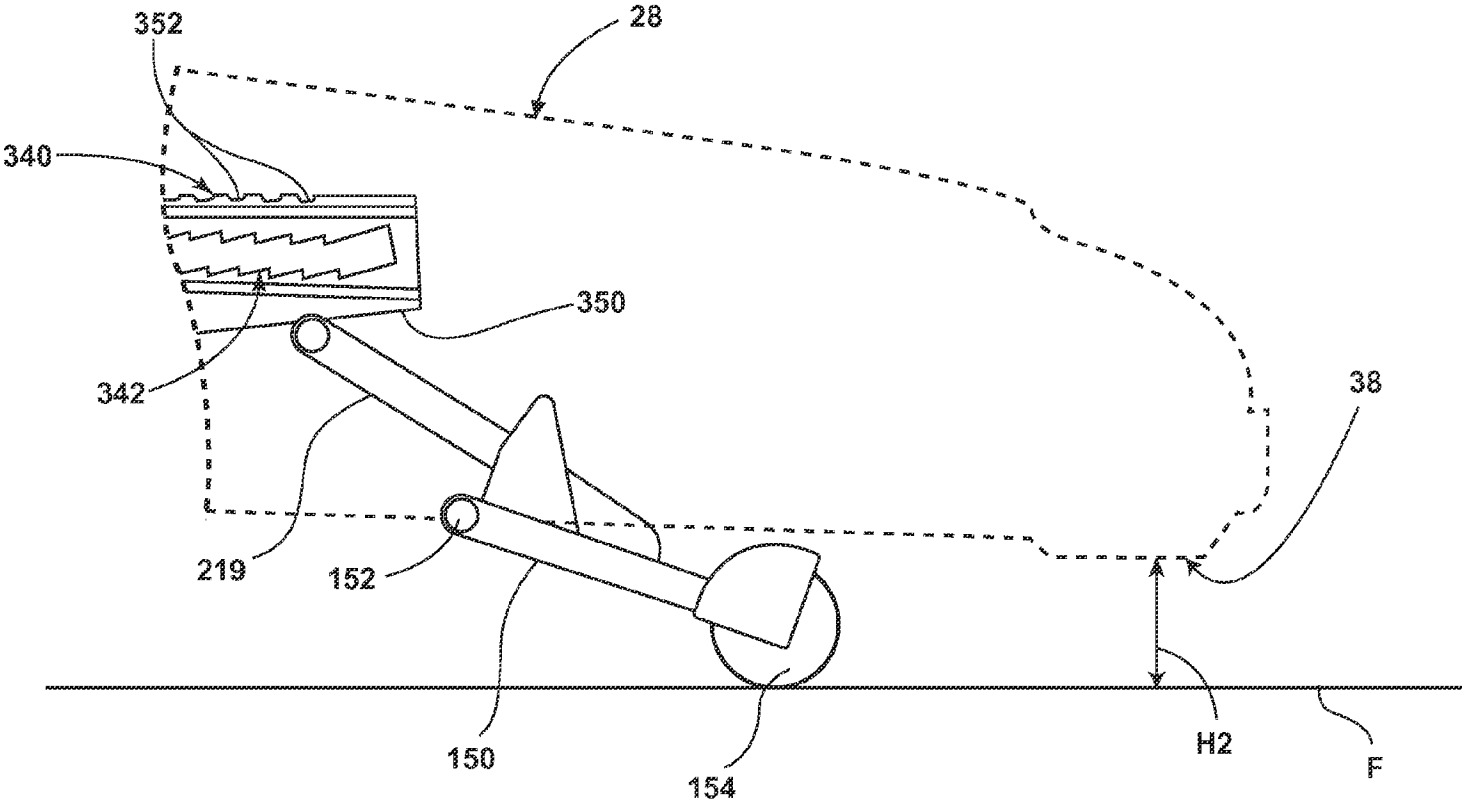

FIGS. 14A-B are schematic side views of the operation of the third alternate nozzle height adjustment mechanism 350 from FIG. 14. Actuation of the nozzle height adjustment mechanism 350 results in changing the position of the carriage assembly 150 relative to the lower housing 28. Specifically, the pivot pins 152 act as a fixed fulcrum point about which the carriage assembly 150 rotates, with the pivot arm 219 and the wheels 154 having a fixed angular relationship to each other. The pivot arm 219 is similar to a lever, in that changing the position of the pivot arm 219 (which is dependent on which portion of the ramped engagement surface 350 the pivot arm 219 is engaging) results in changing the position of the wheels 154. Movement of the wheels 154 away from or towards a bottom surface of the lower housing 28 raises or lowers the front portion of the lower housing 28 relative to a floor surface F, which necessarily adjusts the height of the suction nozzle 38 relative to the floor surface F. FIGS. 14A-B shows the movement of the nozzle height adjustment between a first lowered position (FIG. 14A) in which the suction nozzle 38 is at a height H1 from the floor surface F and a second raised position (FIG. 14B) in which the suction nozzle 38 is at a greater height H2 from the floor surface F. In the first lowered position of FIG. 14A, the pivot arm 219 engages the lower end of the ramped engagement surface 350. To move to the second raised position of FIG. 14B, the foot pedal 354 is pressed as described above with respect to FIG. 14, which causes the trapezoidal housing 346 to be pushed along the grooves 348 relative to the lower housing 28. Movement of the trapezoidal housing 346 changes what portion of the engagement surface 350 that the pivot arm 219 engages, such that rearward movement of the trapezoidal housing 346 as shown in FIG. 14B lowers the wheel 154 relative to the lower housing 28 and increases the height of the suction nozzle 38.

Figure 15:
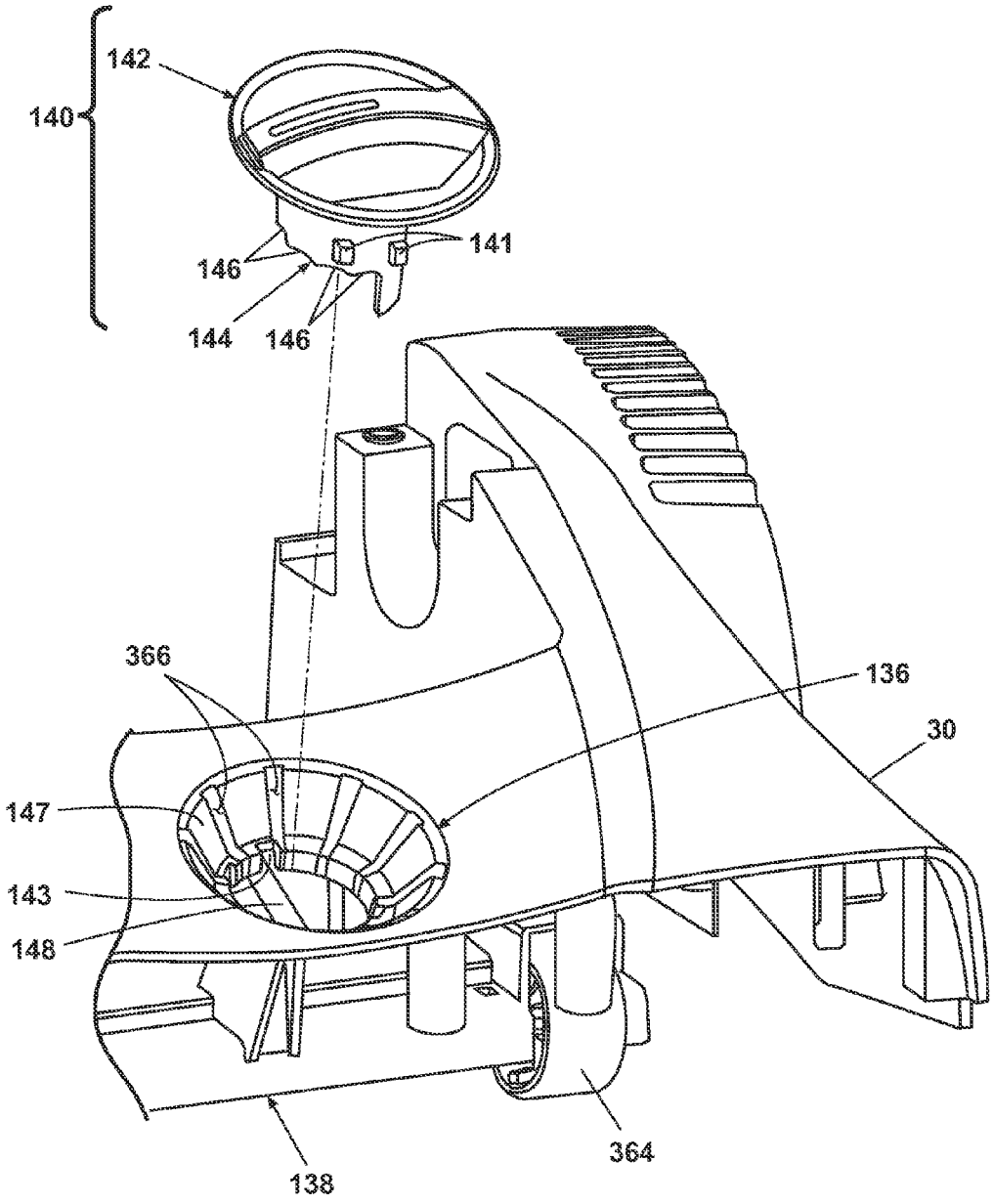
FIG. 15 is an exploded view of a fourth alternate nozzle height adjustment mechanism according to the invention.
Figure 16:
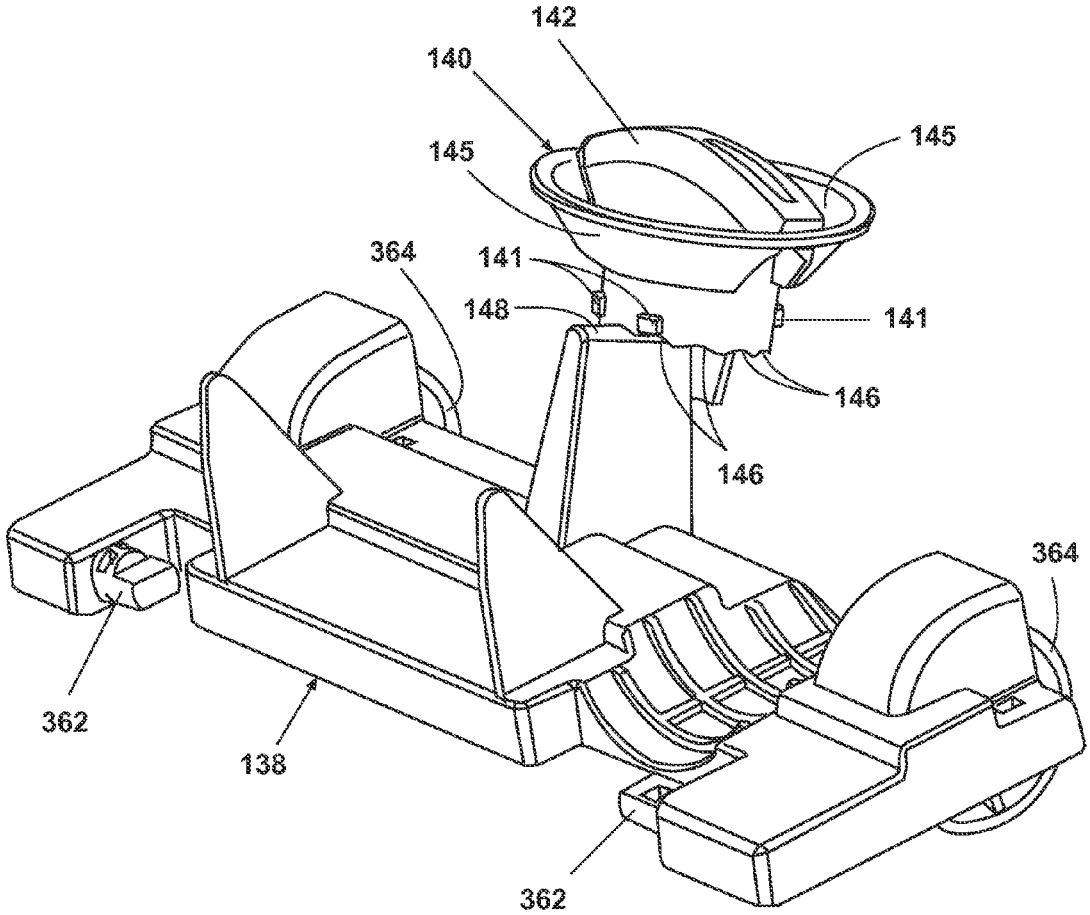
FIG. 16 is a front perspective view of the nozzle height adjustment mechanism from FIG. 15.

Referring to FIGS. 15 and 16, a fourth alternate embodiment of a nozzle height adjustment mechanism is illustrated. A nozzle height adjustment aperture 136 is integrally formed through the upper housing 30 and is aligned with a carriage assembly 138 pivotally mounted to the lower housing 28. A height adjustment actuator 140 comprises an actuator knob 142 on one end and an engaging surface 144 on the other. The engaging surface 144 is comprised of a series of cam lobes 146 that vary in height relative to the actuator knob 142. The engaging surface 144 abuts a corresponding engaging surface 148 on a height adjustment carriage assembly 138. A plurality of rectangular engagement keys 141 protrude from the engaging surface 144. The engagement keys 141 correspond with a like number of engagement slots 143 formed in the height adjustment aperture 136. The keys 141 and slots 143 are oriented so that the height adjustment actuator 140 can be inserted in one orientation only. To assemble the height adjustment assembly, the height adjustment actuator 140 is positioned over the aperture 136 so that the keys 141 align with the slots 143. The actuator 140 is pushed down until a lower surface 145 of the knob 142 abuts an upper surface 147 of the aperture 136. The actuator 140 is then rotated approximately 90 degrees, whereby the keys 141 no longer align with the slots 143 and effectively locking the actuator 140 to the upper housing 30. This locking design and mating of the lower surface 145 to the upper surface 147 serves to effectively seal the generally cylindrical portion of the actuator 140 from dirt and debris that could otherwise enter the assembly and cause binding. Additionally, a plurality of grooves 366 are provided on the upper surface 147 of the aperture 136 and allow any dirt or debris that accumulates around the nozzle height adjustment mechanism to fall between the actuator 140 and the aperture 136 via the grooves.

The carriage assembly 138 further comprises a pivot pins 362 that rotate within the pivot socket 156 integrally molded into the lower housing 28 and a pair of forward freely rotating wheels 364. As the knob 142 is rotated within the aperture 136, the cam lobes 146 interface with the upper surface 147 of the aperture 136, thus raising or lowering the engaging surface 144 relative to the lower housing 28. As the engaging surface 144 is moved down, the carriage assembly 138 rotates downwardly about the pivot points 362, pushing the carriage 138 down toward the surface and effectively raising the suction nozzle 38 away from the surface to be cleaned. Conversely, as the engaging surface is raised, the carriage 138 rotates upwardly toward the lower housing 28 thus minimizing the distance between the suction nozzle 38 and the surface to be cleaned.

Figure 18:
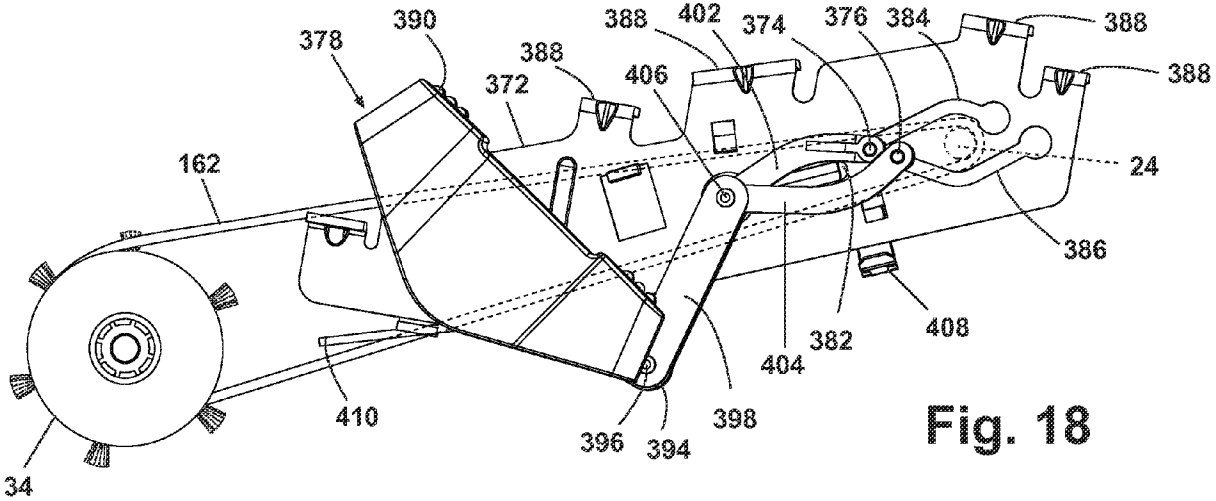
FIG. 18 is a right side view of the drive disengaging mechanism from FIG. 17, illustrating the drive mechanism engaged with the brush.
Figure 18A:
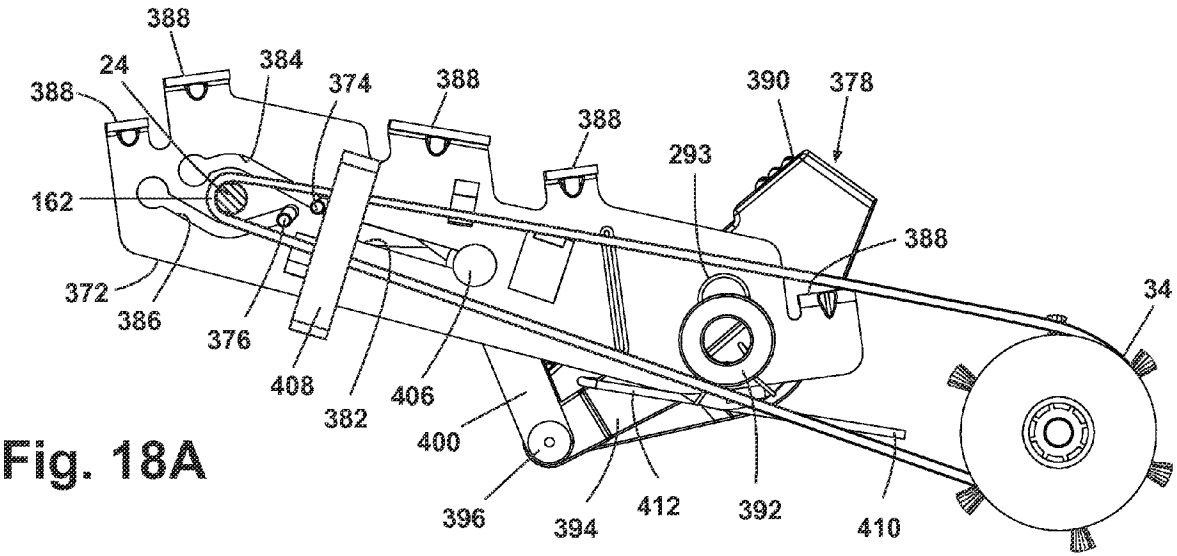
FIG. 18A is a left side view of the drive disengaging mechanism from FIG. 17, illustrating the drive mechanism engaged with the brush.
Figure 19:
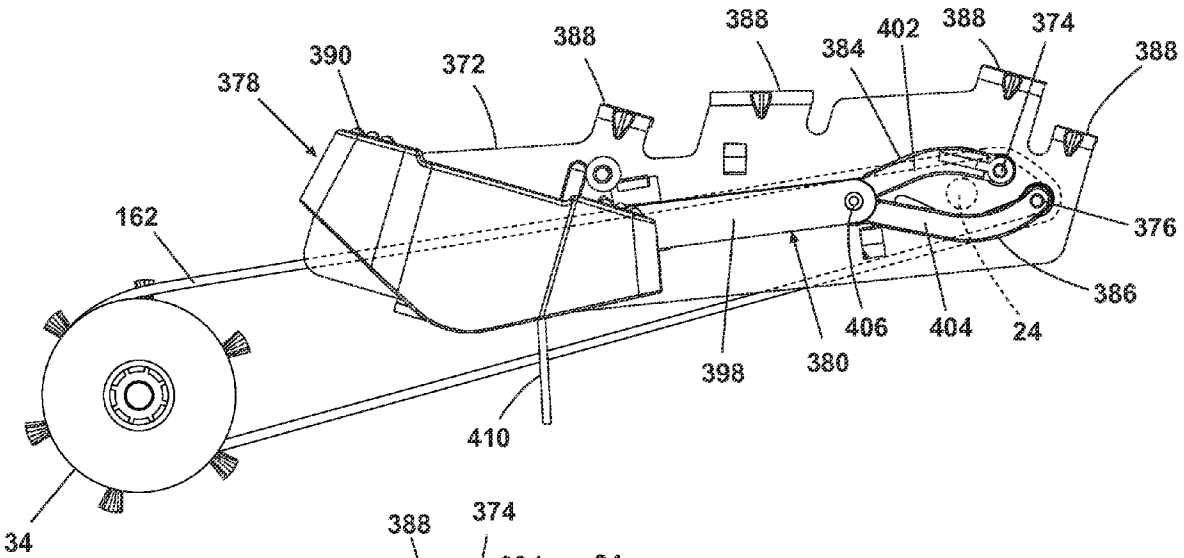
FIG. 19 is a right side view of the drive disengaging mechanism from FIG. 17, illustrating the drive mechanism disengaged from the brush.
Figure 19A:
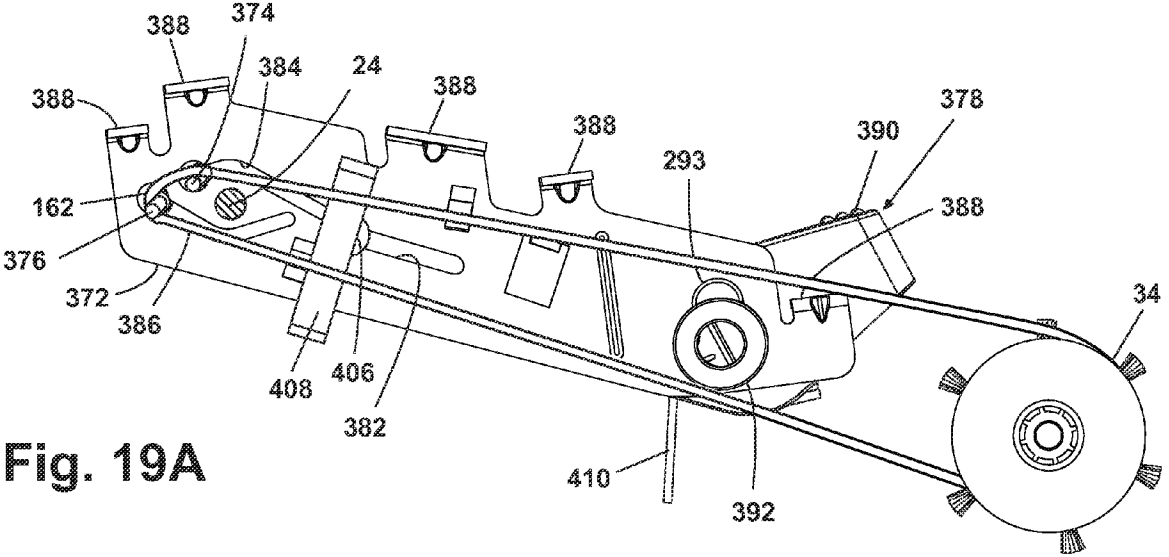
FIG. 19A is a left side view of the drive disengaging mechanism from FIG. 17, illustrating the drive mechanism disengaged from the brush.

While the base assembly 14 is illustrated as comprising the belt disengaging mechanism shown in FIGS. 9 and 10, other belt drive disengaging mechanisms can be used and a few examples of alternate embodiments of suitable belt or drive disengaging mechanisms are illustrated in FIGS. 17-20. Referring to FIG. 17-19A, a first alternate embodiment 370 generally comprises a bracket 372, a pair of belt disengaging pins 374, 376 for disengaging the belt 162 from the motor shaft 24, an actuator 378 for actuating the belt disengager 370, and a linkage 380 between the belt disengaging pins 374, 376 and the actuator 378. The bracket 372 comprises a linear guide track 382, an upper curved guide track 384, a lower curved guide track 386 and a plurality of flanges 388 that facilitate mounting the bracket 372 within the base assembly 14. The actuator 378 comprises a foot pedal 390 provided on the exterior of the base assembly 14 and that is rotatably coupled to the bracket 372 by a foot pedal shaft 392. A retainer spring 393 mounts the foot pedal shaft 392 to the bracket 372. The foot pedal shaft 392 has a rear orthogonal extension 394 pivotally coupled to the linkage 380 by a first pivot pin 396. The linkage 380 comprises a pair of spaced toggle links 398, 400 and a pair of curved arms 402, 404. The toggle links 398, 400 are attached at one end to the rear extension 394 by the first pivot pin 396 and at the other end to one end of the curved arms 402, 404 by a second pivot pin 406, such that the rear extension 394 and the curved arms 402, 404 are both positioned between the toggle links 398, 400. The other end of the curved arms 402, 404 each comprise one of the belt disengaging pins 374, 376, respectively. The second pivot pin 406 is slidingly received in the linear guide track 382, the belt disengaging pin 374 on the upper curved arm 402 is slidingly received in the upper curved guide track 384, and the belt disengaging pin 376 on the lower curved arm 404 is slidingly received in the lower curved guide track 386. A belt guide 408 is provided between the belt 162 and the bracket 372, and prevents the belt 162 from rubbing against the bracket 372 and creating unwanted friction. A spring 410 on the foot pedal shaft 392 having an arm portion 412 wrapped around the rear extension 394 biases the foot pedal 390, and thus the entire belt disengager 370, to the position shown in FIGS. 18 and 18A, wherein the belt 162 is engaged with the motor shaft 24 and drives the brush roll assembly 34. When pressure is applied to the foot pedal 390, the foot pedal shaft 392 rotates clockwise and the rear extension 394 pivots upwardly with respect to the orientation of FIG. 18A. The pivoting motion of the rear extension 394 causes the toggle links 398, 400 pivot clockwise about the first pivot pin 396 and the second pivot pin 406 to slide within the linear guide track 382, which in turn causes the curved arms 402, 404 to slide within their respective curved guide tracks 384, 386 from the position shown in FIG. 18A to the position shown in FIG. 19A. As the curved arms 402, 404 move, the belt disengaging pins 374, 376 engage the belt 162 and lift it from engagement with the motor shaft 24, as can be seen in FIG. 19A, thereby disengaging the belt drive mechanism. The foot pedal 390 or another portion of the actuator 378 can have a detent device (not shown) to maintain the foot pedal 390 in the depressed position shown in FIGS. 19 and 19A and thus maintain the belt in the disengaged position.

Figure 20:
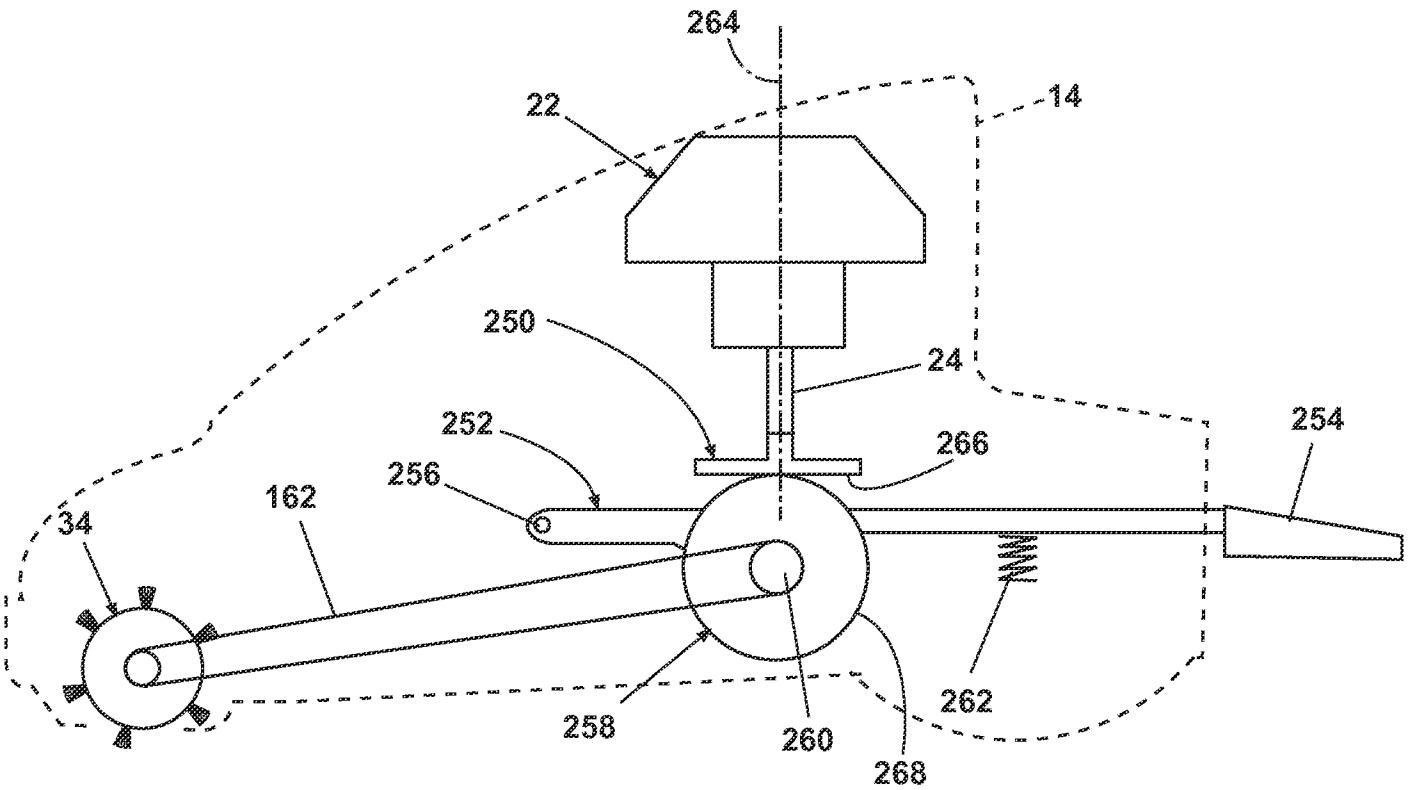
FIG. 20 is a schematic view of a second alternate drive disengaging mechanism according to the invention.

Referring to FIG. 20, in a second alternate embodiment of a drive disengaging mechanism, the motor/fan assembly 22 is fixedly mounted vertically in the base assembly 14. A generally circular flywheel 250 is fixedly attached to and rotates with the motor shaft 24 about a rotational axis 264. The flywheel includes a face 266 in a plane perpendicular to the rotational axis 264. A drive engaging arm 252 is pivotally attached to the lower housing 28 and comprises foot pedal 254 on one end and a pivot point 256 on the other end. A belt drive hub 258 is mounted to the drive engaging arm 252, orthogonally to the flywheel 250, for selective engagement therewith. The belt 162 is in mechanical communication with a drive hub shaft 260 extending from the drive hub 258 and the brush roll assembly 34. The drive engaging arm 252 is biased by a drive engaging spring 262 to place the belt drive hub 258 in selective contact with the fly wheel 250. In operation, the motor shaft 24 rotates when power is applied to the motor/fan assembly 22, causing the flywheel 250 to rotate. The drive engaging spring 262 forces the drive engaging arm 252 to pivot about the pivot point 256 causing the belt drive hub 258 to engage the face 266 of the flywheel 250. As illustrated, a circumferential edge 268 of the belt drive hub 258 may couple with the face 266 for rolling contact therewith. The belt drive hub 258 rotates, which in turn causes the drive hub shaft 260 to rotate, rotating the belt 162 and ultimately the brush roll assembly 34. A commonly known latch (not shown) can be incorporated to secure the drive engaging arm 252 away from the flywheel 250 when the user steps on the foot pedal 254, effectively disengaging the brush drive mechanism when the user desires to use the vacuum cleaner 10 without the aid of a rotating brush roll assembly 34.

As can be appreciated, the drive engaging arm 252 can also pivot laterally so that the belt drive hub 258 can change contact positions on the flywheel 250. For example, when the belt drive hub 258 is positioned near the center of the flywheel 250, the belt drive hub 258 will rotate slowly. As the belt drive hub 258 is moved toward the outer perimeter of the flywheel 250 the speed of the belt drive hub 258, and correspondingly the speed of the brush roll assembly 34, increases thus providing a variable speed brush control.

Figure 21:
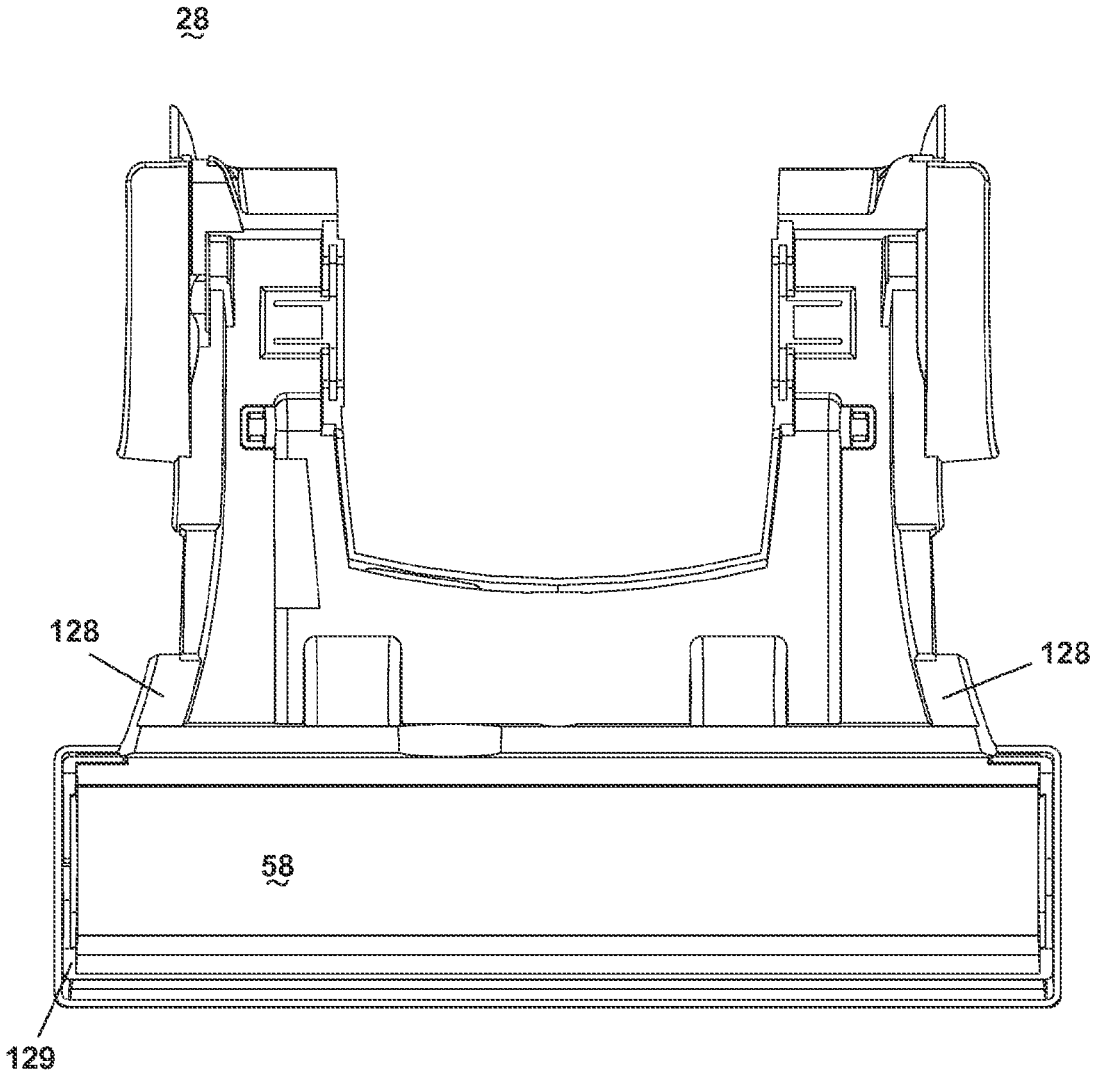
FIG. 21 is a top view of a lower housing of the base assembly from FIG. 4, illustrating a first alternate embodiment of a suction nozzle.
Figure 22:
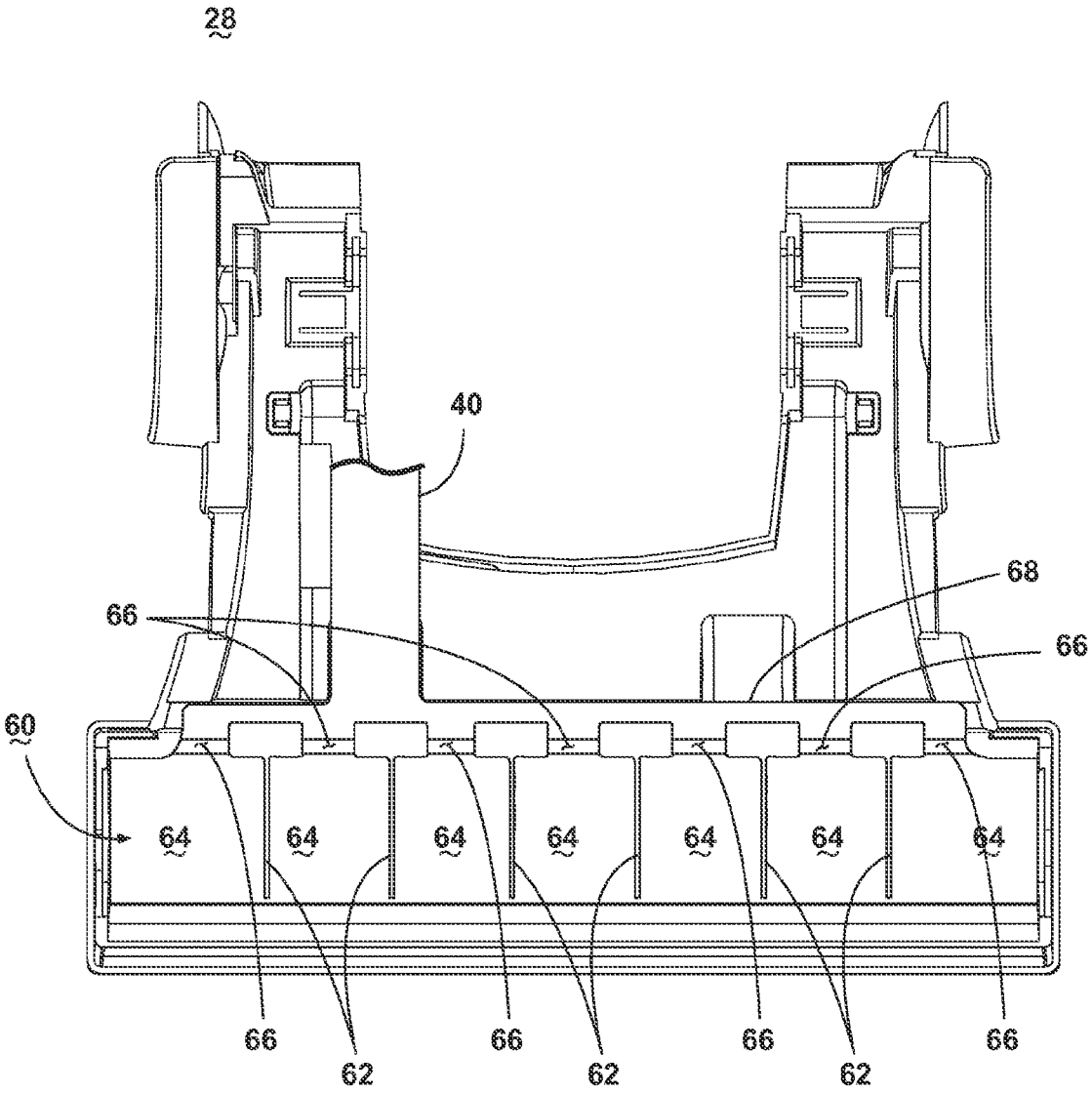
FIG. 22 is a top view of a lower housing of the base assembly from FIG. 4, illustrating a second alternate embodiment of a suction nozzle.

While the base assembly 14 is illustrated as comprising the suction nozzle 38 shown in FIG. 4, other suction nozzles can be used, and a few examples of alternate suction nozzles are illustrated in FIGS. 21 and 22. Referring to FIG. 21, a first alternate embodiment comprises a suction nozzle extension 128 extends in a rearward direction at either side of the lower housing 28, forming a generally U-shaped suction nozzle 58. In this way, the suction nozzle 58 surrounds the forward portion of the lower housing 28 for cleaning additional surface area as well as improved edge cleaning In addition, an optional pet hair removal device 129 is included near the suction nozzle 58 and is formed of a rubber or plastic material create a static charge when exposed to frictional forces are mounted around the suction nozzle 58 to further enhance cleaning Alternatively, the pet hair removal devices 129 can be made of a conventional lint brush material. A more complete description of suitable pet hair removal devices can be found in U.S. Provisional Patent Application 60/594,773 which is incorporated herein by reference in its entirety.

Referring to FIG. 22, a second alternate embodiment of a suction nozzle 60 for the base assembly 14 is illustrated, wherein the suction nozzle 60 comprises a plurality of partitions 62 sectioning the suction nozzle 60 into a plurality of individual suction chambers 64 across the width of the suction nozzle 60. Each suction chamber 64 has an outlet port 66 in communication with a common manifold conduit 68 in fluid communication with the motor fan assembly 22 via the foot conduit 40 or other suitable means.

Figure 23:
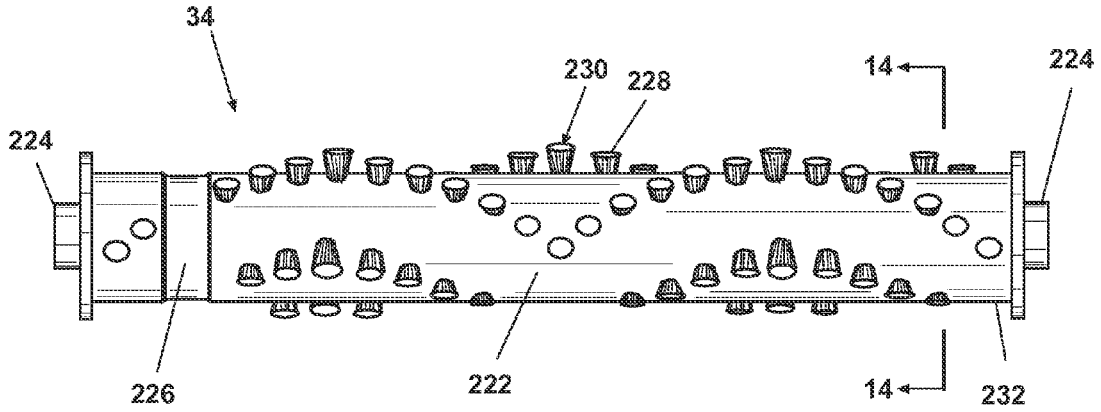
FIG. 23 is a front view of a brush roll assembly according to the invention.

Referring to FIGS. 23-26, various embodiments of the brush roll assembly 34 are illustrated. It is within the scope of this invention to incorporate any of the following brush roll assemblies on the base assemblies 14 previously described. Referring to FIG. 23, a first embodiment of the brush roll assembly 34 comprises a generally cylindrical brush dowel 222 with a bearing surface 224 on both ends and a belt engagement surface 226 around the circumference near one end that communicates with the belt 162. A plurality of flexible bristles 228 are inserted into the outer circumference of the brush dowel 222 forming individual tufts 230. Typically the bristles 228 are finished by trimming the bristles 228 after they are inserted into the brush dowel 222 resulting in a squared off end of the bristle 228. A plurality of tufts 230 are arranged in a generally helix fashion in rows 232 along the outer circumference of the brush dowel as is typical in the vacuum art. In addition, the brush roll assembly can be biased so that a constant down force is provided to ensure even and consistent contact with the surface to be cleaned as is disclosed in U.S. Pat. No. 6,934,993, issued Aug. 30, 2005, which is incorporated herein by reference in its entirety. As can be appreciated, the number of bristles 228 used to form each tuft 230, the number of tufts 230 used to form each row 232, and the number of rows 232 used on the brush dowel 222 can all be varied to create an optimum agitation device. Furthermore, the helix angle of the rows 232 can be increased to give a high helix angle pattern resulting in a greater bristle 228 surface area. In an alternate embodiment, the bristle end that engages the surface to be cleaned is rounded and the tufts 230 are created by inserting the bristle 228 into the brush dowel 222 so that a finished diameter is created upon insertion with no need for finish trimming. Alternatively, the bristle 228 ends can be rounded after trimming similar to the configuration of the bristles of a toothbrush. The rounded bristle 228 end creates a smoother bristle surface area that is preferred on the more delicate surface finishes such as wood and carpet.

Figure 24:
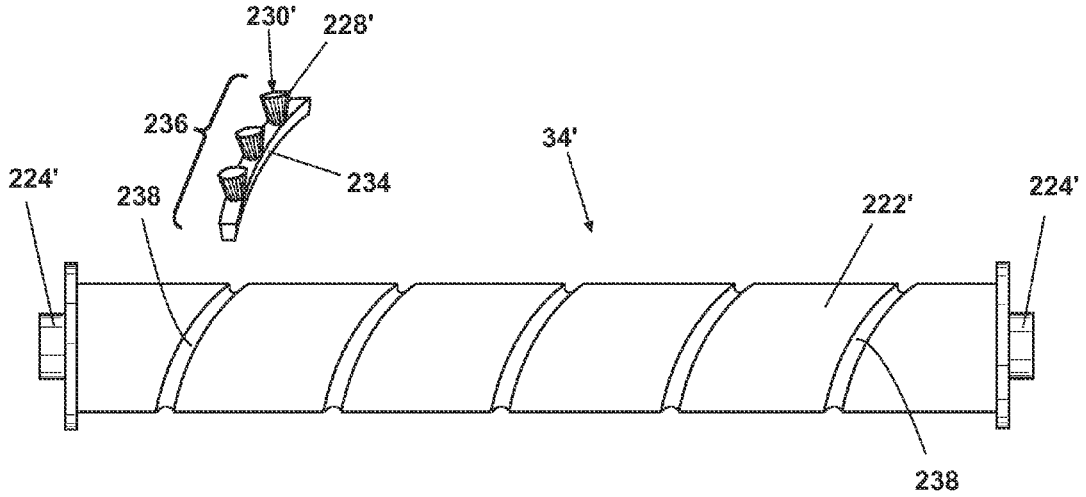
FIG. 24 is a front view of an alternate brush roll assembly according to the invention.

Referring to FIG. 24, in a second embodiment, where like elements are indicated by the same reference numeral bearing a prime symbol (′), the tufts 230′ are attached to a flexible support 234 forming a bristle strip 236 that is removably inserted into a channel 238 formed in the dowel 222'. A number of different bristle strips 236 that vary the material, length, or stiffness of the bristles 228' can be used to give the user options based upon their particular cleaning needs. For example, softer bristles 228' are preferred on more delicate floors such as wood or delicate carpets to prevent damage while stiffer bristles 228' are desired on hard tiled surfaces to more aggressively remove debris that is stuck to the surface to be cleaned. In addition, the use of bristle strips 236 provides for easy maintenance of the brush because the bristles can be replace without removing the brush roll assembly 34' from the base assembly 14.

Figure 25:
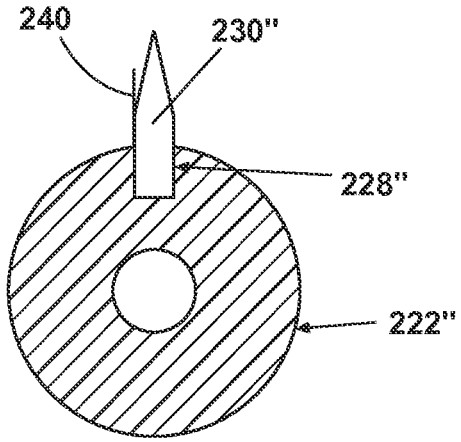
FIG. 25 is a cross sectional view of an alternate brush roll assembly according to the invention.

Referring to FIG. 25, in a third embodiment wherein like elements are identified by the same reference numerals bearing a double prime symbol ("), each tuft 230" is cut on an angle so that the angled surface is in contact with the surface to be cleaned. This allows for more of the bristle 228"ends to remain in contact with the surface to be cleaned resulting in improved cleaning performance. Alternatively, the tuft 230" can be trimmed at an angle on both sides so that a more flexible tuft 230" is created. In yet another embodiment, a stiffener 240 is embedded in the dowel 222" behind the tuft 230" relative to the direction of rotation that effectively creates a stiffer tuft 230" while improving dynamic flexing characteristics. Alternatively, the stiffener 240 can be integrally formed in the brush dowel 222" or can be mechanically fastened to the brush dowel 222" after the tufts 230" have been inserted via commonly known methods such as rivets, screws, or adhesives. Furthermore, the stiffeners 240 can be formed as a continuous strip that extends between the tufts 230" or can be individually placed behind each tuft 230". Additionally, the tufts 230" can be stiffened by counter boring each tuft to provide the wall required to stiffen the bristle 228".

Figure 26:
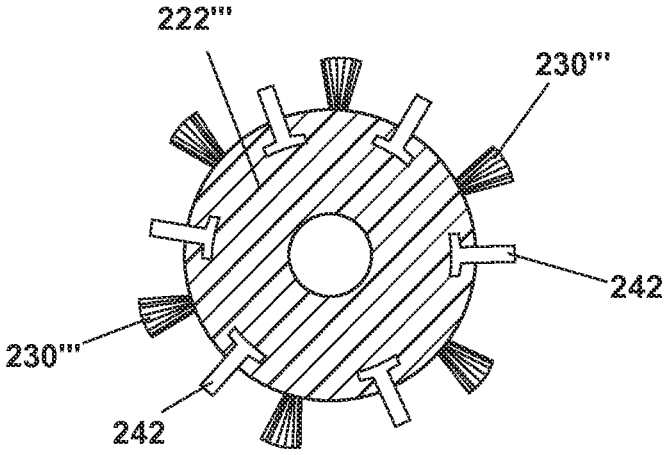
FIG. 26 is a cross sectional view of a second alternate brush roll assembly according to the invention.

Referring to FIG. 26, in a fourth embodiment wherein like elements are identified by the same reference numerals bearing a triple prime symbol (''') a plurality of static strips 242 are formed of a suitable rubber or plastic material that creates a static charge when exposed to frictional forces. The static strips 242 are inserted into the channels in the dowel 222''' as previously described. Different materials create different static charges that are suitable for attracting specific debris types such as dust, pollens, pet hair, and dirt. One or more static strip 242 of the same or different material types can be used in the dowel 222''' depending upon the user's preference.

While the invention has been specifically described in connection with certain specific embodiments thereof, it is to be understood that this is by way of illustration and not of limitation. Reasonable variation and modification are possible within the scope of the foregoing description and drawings without departing from the spirit of the invention which is defined in the appended claims.

What is claimed is:

1. A vacuum cleaner comprising:

a base assembly having a housing, a suction nozzle, a pair of wheels at a rear portion of the housing, a support at a front portion of the housing, and an adjuster between the housing and the support to selectively adjust the vertical position of the suction nozzle with respect to a surface to be cleaned;

wherein the adjuster comprises:

a ratchet mechanism comprising a drum movably mounted between the support and the housing for movement between a raised position and a lowered position, the ratchet mechanism being shaped to raise the housing with respect to the support in the raised position and to lower the housing with respect to the support in the lowered position, wherein the drum comprises a plurality of detents in an outer surface thereof;

a first actuation rod; and a foot pedal moveably mounted to the housing and coupled at one end to the first actuation rod to incrementally move the ratchet mechanism between the raised and lowered positions as the foot pedal is pressed;

wherein the first actuation rod is positioned between the foot pedal and the drum and is adapted to rotate the drum and selectively register with successive detents on the drum when the foot pedal is pressed.

2. The vacuum cleaner according to claim 1 wherein the ratchet mechanism further comprises a second actuation rod that is slideably mounted to the support and has a tooth that selectively engages one of the detents and retains the drum in a predetermined position between movements of the first actuation rod.

3. The vacuum cleaner according to claim 2 wherein the foot pedal comprises a first portion and a second portion and whereby pressure on the first portion moves the first actuation rod in one direction and pressure on the second portion moves the second actuation rod.

4. The vacuum cleaner according to claim 3 wherein the ratchet mechanism further comprises a biasing member for biasing at least one of the first and second actuation rods into engagement with one of the plurality of detents.

5. The vacuum cleaner according to claim 1 wherein the foot pedal is pivotably mounted to the housing and is adapted to move the ratchet mechanism to the raised position by pivoting the pedal in a first direction, and to move the ratchet mechanism to the lowered position by pivoting the pedal in a second direction.

6. The vacuum cleaner according to claim 2 wherein the first actuation rod comprises a first pedal engagement surface on one end thereof which engages a first portion of the foot pedal and the second actuation rod comprises a second pedal engagement surface on one end thereof which engages at second portion of the foot pedal, wherein pressing the first portion of the foot pedal moves the drum in a first direction and pressing the second portion of the foot pedal moves the drum in a second direction that is opposite the first direction.

7. The vacuum cleaner according to claim 1 wherein the first actuation rod further comprises a pedal engagement surface on one end thereof which engages the foot pedal and a ratchet engagement surface on the other end thereof which engages the engages the drum.

8. A vacuum cleaner comprising:

a base assembly having a housing, a suction nozzle, a pair of wheels at a rear portion of the housing, a support at a front portion of the housing, and an adjuster between the housing and the support to selectively adjust the vertical position of the suction nozzle with respect to a surface to be cleaned;

wherein the adjuster comprises:

a ratchet mechanism movably mounted between the support and the housing for movement between a raised position and a lowered position, the ratchet mechanism being shaped to raise the housing with respect to the support in the raised position and to lower the housing with respect to the support in the lowered position;

a first actuation rod; and a foot pedal mounted to the housing for movement between a raised position and a lowered position and adjustably connected at one end to the ratchet mechanism to incrementally move the ratchet mechanism between the raised and lower positions as the foot pedal is moved between the raised and lowered positions;

wherein the ratchet mechanism comprises:

a drum mounted to the support and including a plurality of detents on an outer surface thereof, wherein the first actuation rod is positioned between the foot pedal and the drum and is adapted to selectively register with successive detents on the drum as the foot pedal is moved between the raised and lowered positions; and a second actuation rod that is slideably mounted to the support and has a tooth that selectively engages one of the detents and retains the drum in a predetermined position between movements of the first actuation rod.

9. The vacuum cleaner according to claim 8 wherein the foot pedal comprises a first portion and a second portion and whereby pressure on the first portion moves the first actuation rod in one direction and pressure on the second portion moves the second actuation rod.

10. The vacuum cleaner according to claim 9 wherein the ratchet mechanism further comprises a biasing member for biasing at least one of the first and second actuation rods into engagement with one of the plurality of detents.

11. The vacuum cleaner according to claim 8 wherein the foot pedal is pivotably mounted to the housing and is adapted to move the ratchet mechanism to the raised position by pivoting the pedal in a first direction, and to move the ratchet mechanism to the lowered position by pivoting the pedal in a second direction.

* * * * *